United States Patent [19]

Allen et al.

[11] 4,106,227

[45] Aug. 15, 1978

[54] SPREADING APPARATUS FOR SHEET FEEDER

[75] Inventors: William W. Allen, Plantation; Charles E. Sweeney, Margate; Alvin G. Lundquist, Jr., Ft. Lauderdale; Raymond T. Hersh, Coral Springs, all of Fla.

[73] Assignee: Jensen Corporation, Ft. Lauderdale, Fla.

[21] Appl. No.: 838,750

[22] Filed: Oct. 3, 1977

[51] Int. Cl.[2] ..... D06F 67/04

[52] U.S. Cl. ..... 38/143

[58] Field of Search ..... 38/7, 143; 198/464; 270/62.66; 271/18, 84, 85

[56] References Cited

U.S. PATENT DOCUMENTS

| | | | |
|---|---|---|---|
| 3,431,665 | 3/1969 | Weir | 38/143 |
| 3,604,132 | 9/1971 | Thompson | 38/143 |
| 4,050,173 | 9/1977 | Olsen | 38/143 |

*Primary Examiner*—Louis K. Rimrodt
*Attorney, Agent, or Firm*—Oltman and Flynn

[57] ABSTRACT

This apparatus is for spreading laundry flatwork pieces, such as bed sheets, before feeding them to subsequent processing equipment, such as an ironer and a folder. Separate pairs of flatwork clamps are normally located respectively at the left end, middle and right end of the apparatus. The left end and right end clamps are movable straight across the entry side of the apparatus to the middle before being spread apart. The paired clamps operate to spread their respective flatwork pieces in the order in which their respective start switches are operated manually. Interference among the paired clamps or between the clamps of each pair is prevented. No intermediate flatwork transfer operation is required between the insertion of a flatwork piece into a pair of clamps and the spreading of that flatwork piece.

22 Claims, 26 Drawing Figures

FIG. 6
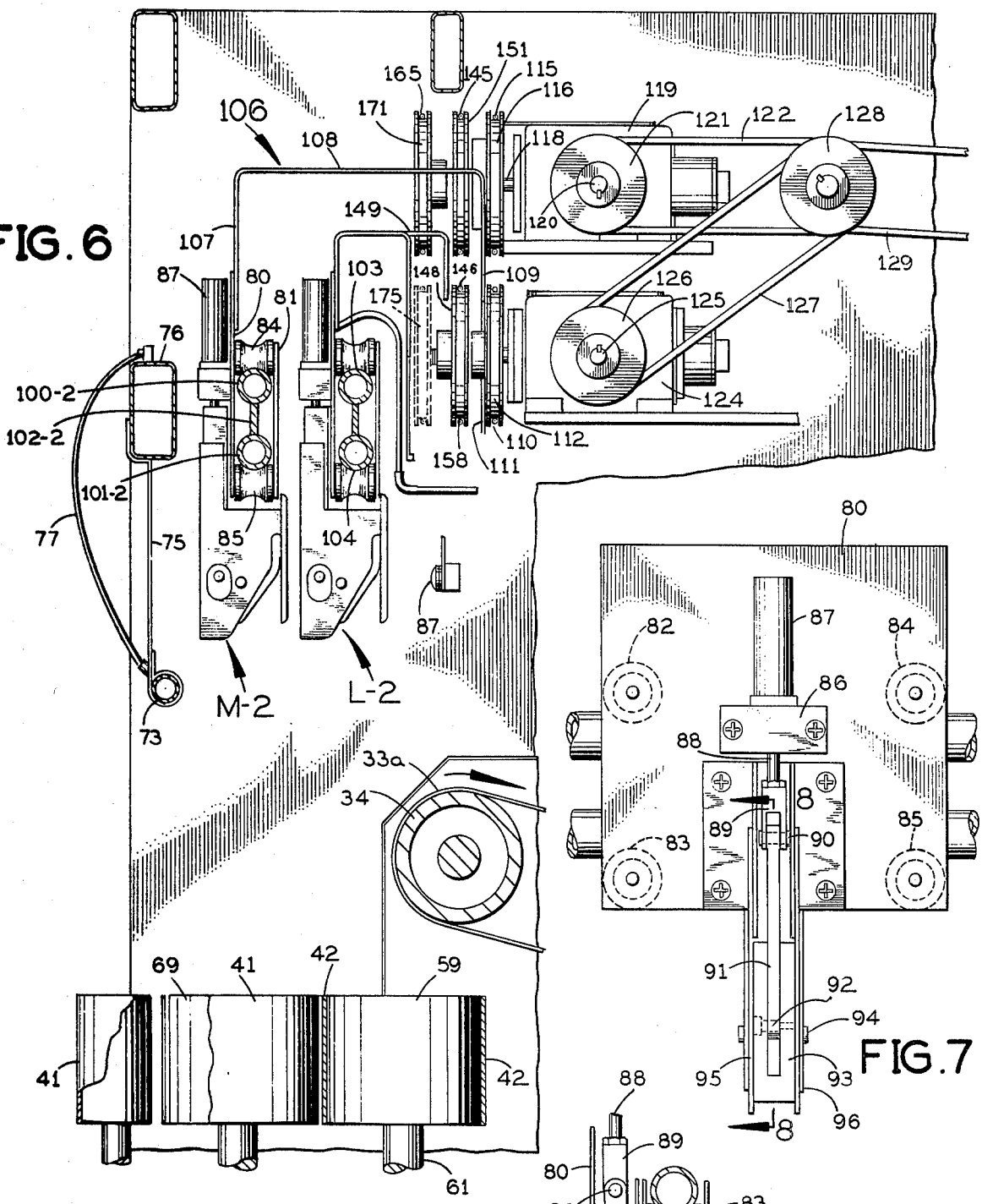
FIG. 7
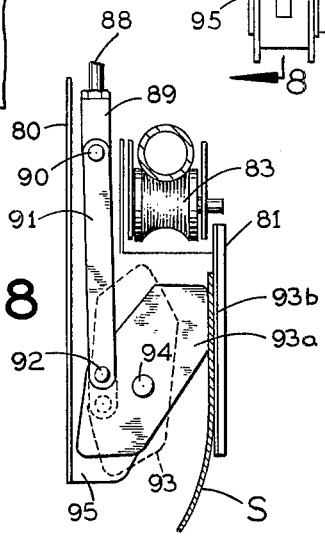
FIG. 8

R-1
R-2
M-1
M-2
L-1
L-2

SPREADING APPARATUS FOR SHEET FEEDER

BACKGROUND OF THE INVENTION

Various machines have been proposed heretofore for spreading a bed sheet or other piece of laundry flatwork and feeding it to an ironer and a folder. Such machines are used by hotels, hospitals and similar institutional laundries. Typically, such machines have two clamps for holding the adjacent corners along one edge (the top edge) of the flatwork. After these corners are inserted, the clamps are moved apart to the left and right, respectively, to spread the flatwork along this edge. Then the clamps release the corners of the flatwork and the leading (upper) end of the flatwork is placed onto a conveyor, which advances the flatwork to the ironer or other processing equipment. The trailing part of the flatwork is spread by laterally outwardly moving confronting segments of endless flexible belts before passing up onto the conveyor.

Various machines of this general type have been designed to accommodate two or more operators at different loading stations. For example, the machine shown in U.S. Pat. No. 3,376,036 to Weir has two laterally spaced loading stations, the machine shown in U.S. Pat. No. 3,664,046 to Thompson has three loading stations, and the apparatus shown in U.S. Pat. No. 3,729,846 to Weir has four. Such machines require transfer devices for transferring flatwork pieces from each of the loading stations to clamps at the middle of the machine.

SUMMARY OF THE INVENTION

The present invention is directed to a novel and improved spreading apparatus for flatwork, such as bed sheets, which obviates the need for transfer devices at the inlet side of the flatwork-spreading clamps. In accordance with the preferred embodiment of this invention, three pairs of such clamps are provided, one pair for each operator station. Each operator inserts the adjacent corners of the leading (upper) edge of a piece of flatwork at his or her station into the pair of clamps located there. At each end station that station's clamps move in unison to the middle of the apparatus before being spread apart to the left and right, respectively. At the middle station this preliminary movement of the middle pair of clamps is not necessary because their normal position is at the middle of the apparatus. At each of the three stations, the respective operator inserts a flatwork piece into the corresponding pair of clamps, and these clamps continue to hold that flatwork piece until its leading (upper) edge has been spread and the flatwork piece is ready to be blown onto the conveyor which will carry it to the ironer or other processing equipment. There is no transfer operation between the operator and the flatwork-spreading clamps, and this is advantageous from the standpoint of simplicity, positiveness of operation and operator safety.

A principal object of this invention is to provide a novel and improved spreading apparatus for laundry flatwork.

Another object of this invention is to provide such an apparatus having a plurality of operator work stations at different locations across the entry side of the apparatus where the flatwork may be inserted but which does not require a transfer of the flatwork piece after the operator inserts it and before it is spread.

Another object of this invention is to provide a novel flatwork spreading apparatus having three operator work stations spaced apart across its entry side at which paired clamps are normally located, and a novel and simplified drive arrangement for effecting straight-line movements of the clamps to spread the respective flatwork pieces in the desired sequence.

Another object of this invention is to provide such a spreading apparatus which controls the sequential movements of the clamps so that they do not interfere with one another.

Further objects and advantages of this invention will be apparent from the following detailed description of a presently-preferred embodiment thereof, shown in the accompanying drawings in which:

FIG. 6 is a fragmentary vertical section taken along the line 6—6 in FIG. 2 at the middle of the apparatus and showing certain of the clamps and the drives therefor;

FIG. 7 is a front elevational view of one of the clamps;

FIG. 8 is a vertical section taken along the line 8—8 in FIG. 7;

Before explaining the disclosed embodiment of the invention in detail, it is to be understood that the invention is not limited in its application to the details of the particular arrangement shown since the invention is capable of other embodiments. Also, the terminology used herein is for the purpose of description and not of limitation. For convenience of description, the laundry flatwork will be referred to as a "sheet". However, it is to be understood that the laundry flatwork may be other than a sheet.

Figure 1:
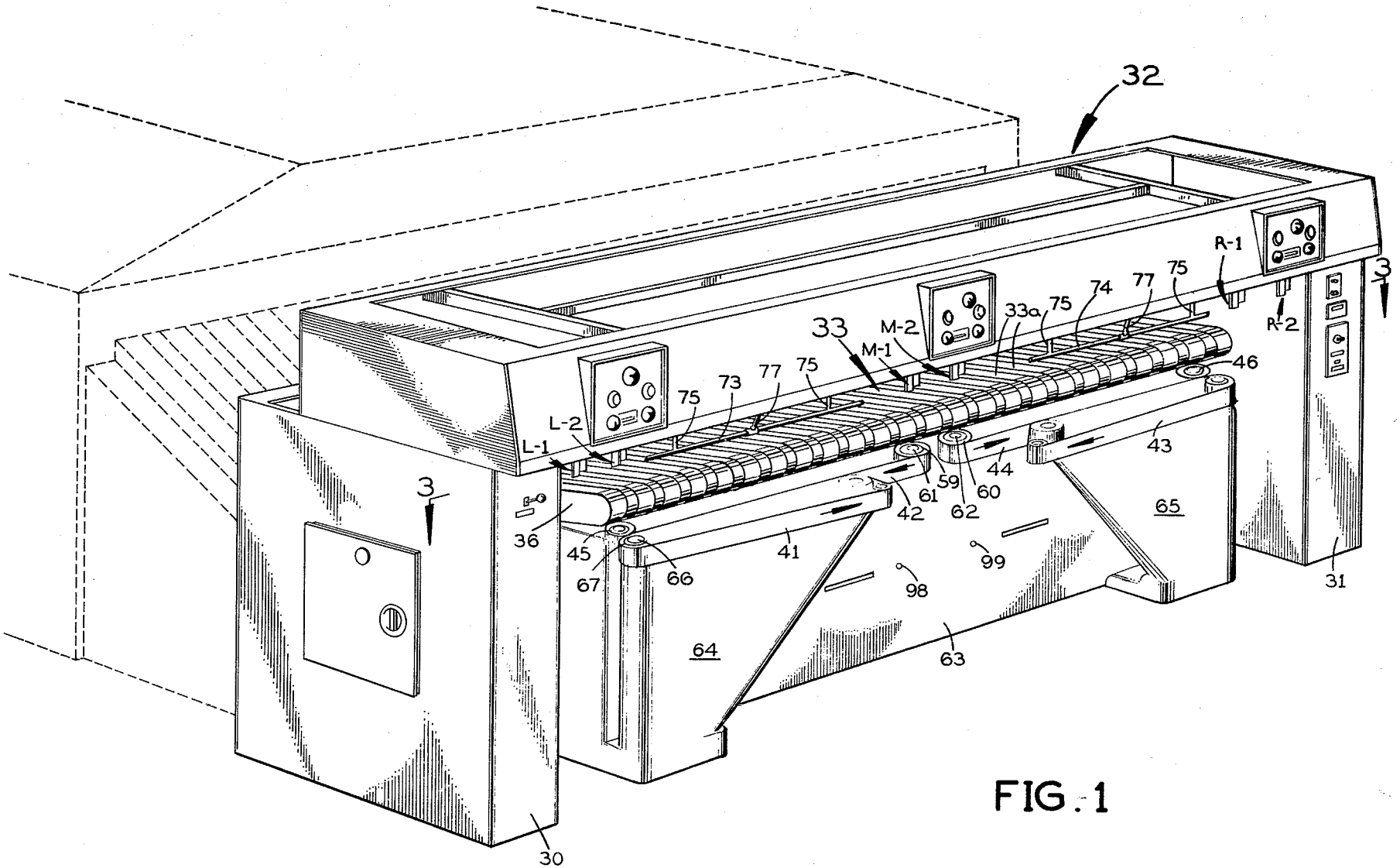
FIG. 1 is a perspective view of the present apparatus taken from its entry side.

Referring first to FIG. 1, the present apparatus has a framework with laterally spaced, wheel-mounted, upstanding sheet metal, end cabinets 30 and 31 and a horizontally elongated top carriage 32 extending between the end cabinets at the top and slidably adjustable between the normal operating position, shown in FIG. 1, and a retracted position, shown in FIG. 21, for a purpose explained hereinafter.

Figure 5:
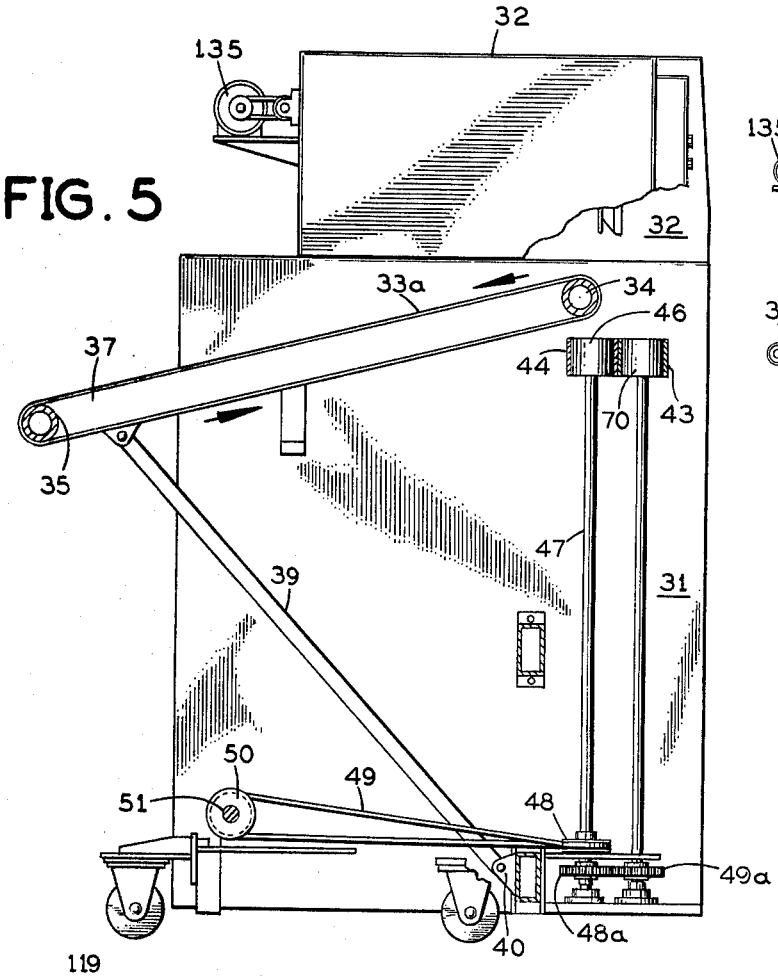
FIG. 5 is a vertical section taken along the line 5—5 in FIG. 2 near the right end of the apparatus.

A wide, flexible endless belt conveyor 33 is located below the top carriage 32 and extends for almost the complete lateral distance between the upstanding end cabinets 30 and 31. This conveyor has a plurality of laterally spaced, relatively narrow, flexible endless belts **33*a* which are inclined downwardly into the apparatus (which for convenience of description will be referred to as the forward direction). As shown in FIG. 5, the conveyor belts 33*a* extend up around a horizontal roller 34 at the entry side of the apparatus and down around a lower horizontal roller 35 located forward, (i.e., into the apparatus) from roller 34. Roller 34 is driven from an electric motor 36 (FIG. 3) located inside the right end cabinet 31 of the apparatus. Roller 35** is simply an idler roller.

Figure 3:
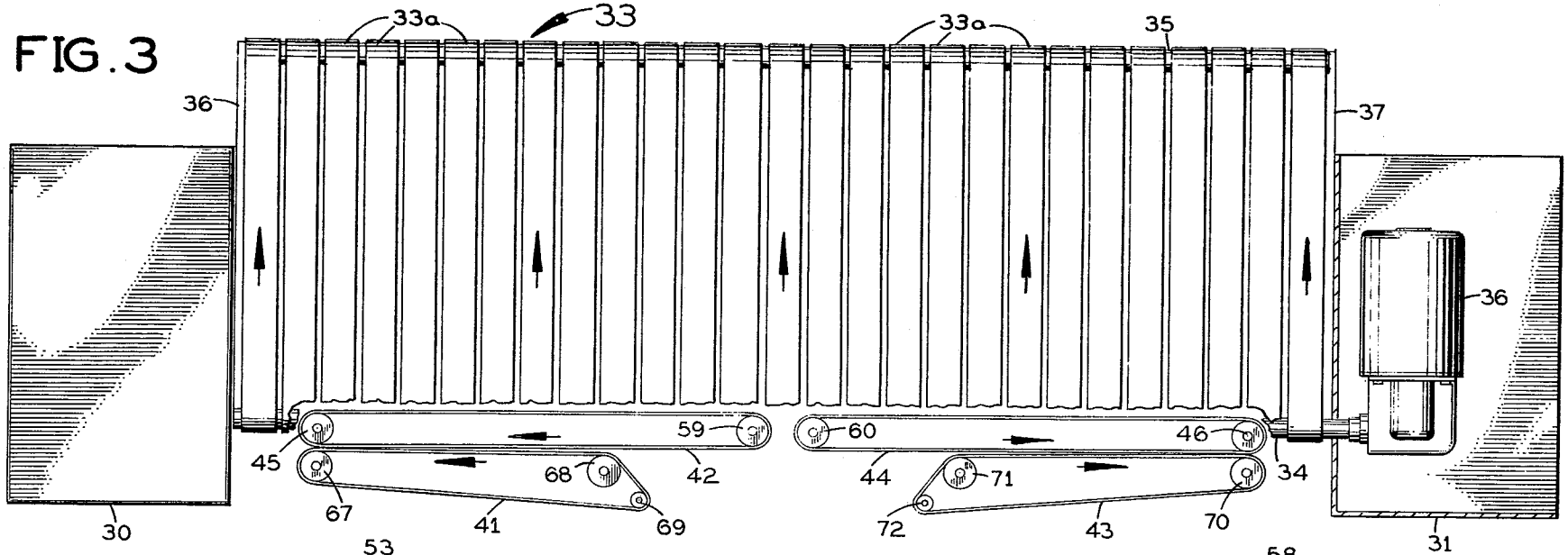
FIG. 3 is a horizontal longitudinal section taken along the line 3—3 in FIG. 1 near the top of the apparatus.

The conveyor belts **33*a* are driven in the direction indicated by the arrows in FIGS. 1, 3 and 5, with the upper run or course of the belts going forward into the apparatus from roller 34 to roller 35 at a downward inclination and the bottom return run coming rearward from roller 35 at an upward inclination toward roller 34. The drive roller 34 at the entry side of the apparatus is rotatably supported at its left end in the cabinet 30. The idler roller 35 is rotatably supported at each end by respective rigid end pieces 36 and 37 (FIG. 3), which are located just inside the respective end cabinets 30 and 31 of the apparatus framework. These end pieces have the same inclination as the conveyor belts and they are respectively supported from below by inclined posts 38 (FIG. 21) and 39 (FIG. 5) whose lower ends are connected to the framework of the apparatus at the bottom, as shown at 40 in FIG. 5. Although not shown in the drawing, the support posts 38 and 39 may have telescopically interfitting sections which enable the height of roller 35 to be adjusted, and this of course determines the angular inclination of the conveyor belts 33*a***.

At the entry side of the machine (FIG. 1) two pairs of confronting, laterally directed, flexible endless belts 41–42 and 43–44 are located a short distance below the conveyor belts **33*a*. The paired belts 41–42 are at the left side of the longitudinal centerline of the conveyor 33, and the paired belts 43–44 are at the right side of this centerline. The belts 41–42 of the left-hand pair and the belts 43–44 of the right-hand pair are driven in the directions indicated by the arrows of FIG. 1. As best seen in FIG. 3, the left-hand belts 41–42 present contiguous runs which move from the center laterally outward to the left for spreading from the center to the left the part of a sheet which passes up between them. The right-hand belts 43–44 present contiguous runs which move from the center laterally outward to the right for spreading from the center to the right another part of the same sheet passing up between them. Therefore, the paired belts 41–42 and 43–44** will be referred to as spreader belts.

The respective forwardly-positioned spreader belts 42 and 44 are longer than the respective rear spreader belts 41 and 43 with which they are paired, extending laterally inward past the latter toward the longitudinal centerline of the apparatus. This provides a gap between the rear belts 41 and 43 midway across the apparatus at its entry side where a sheet may hang down directly behind the front belts 42 and 44. This facilitates the passage of the sheet up between the confronting pairs of spreader belts 41–42 and 43–44, with the belts 41–42 spreading part of the sheet to the left as it passes up between them and with the belts 43–44 spreading another part of the sheet to the right as it passes up between them.

Belt 42 is driven by a vertical drive roller 45 (FIG. 3) at its left end, and belt 44 is driven by a vertical drive roller 46 (FIG. 3) at its right end. As shown in FIG. 5, the drive roller 46 for belt 44 is on the upper end of a vertical shaft 47 which carries a grooved horizontal pulley 48 near its lower end. Pulley 48 is driven by a flexible endless belt which is twisted through 90° and has its end driven by a pulley 50 on a horizontal drive shaft 51. Shaft 51 is driven from an electric motor 52 (FIG. 4).

Figure 4:
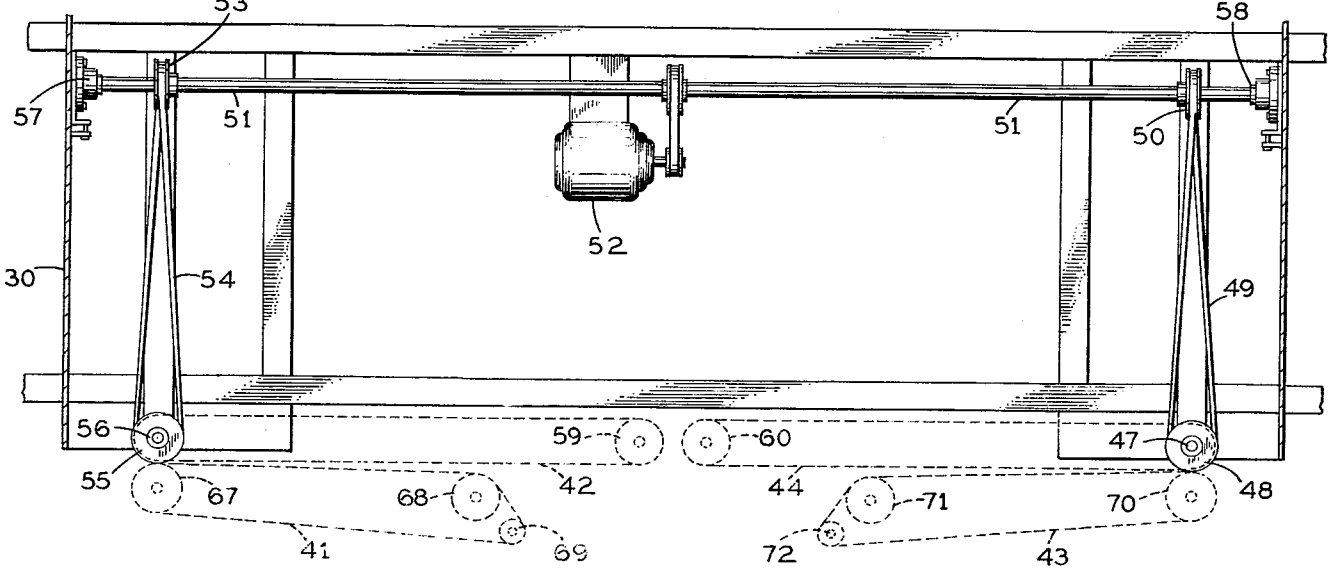
FIG. 4 is a horizontal longitudinal section taken along the line 4—4 in FIG. 2 near the bottom of the apparatus.

Shaft 51 extends laterally across the apparatus near the bottom and, as shown in FIG. 4, near the left end cabinet 30 of the apparatus framework it carries a pulley 53 which drives a pulley 55 on a vertical shaft 56 which carries the drive roller 45 for belt 42 at its upper end. Likewise, pulley 50 drives belt 49 which drives pulley 48 on a vertical shaft 47 for drive roller 46.

Figure 2:
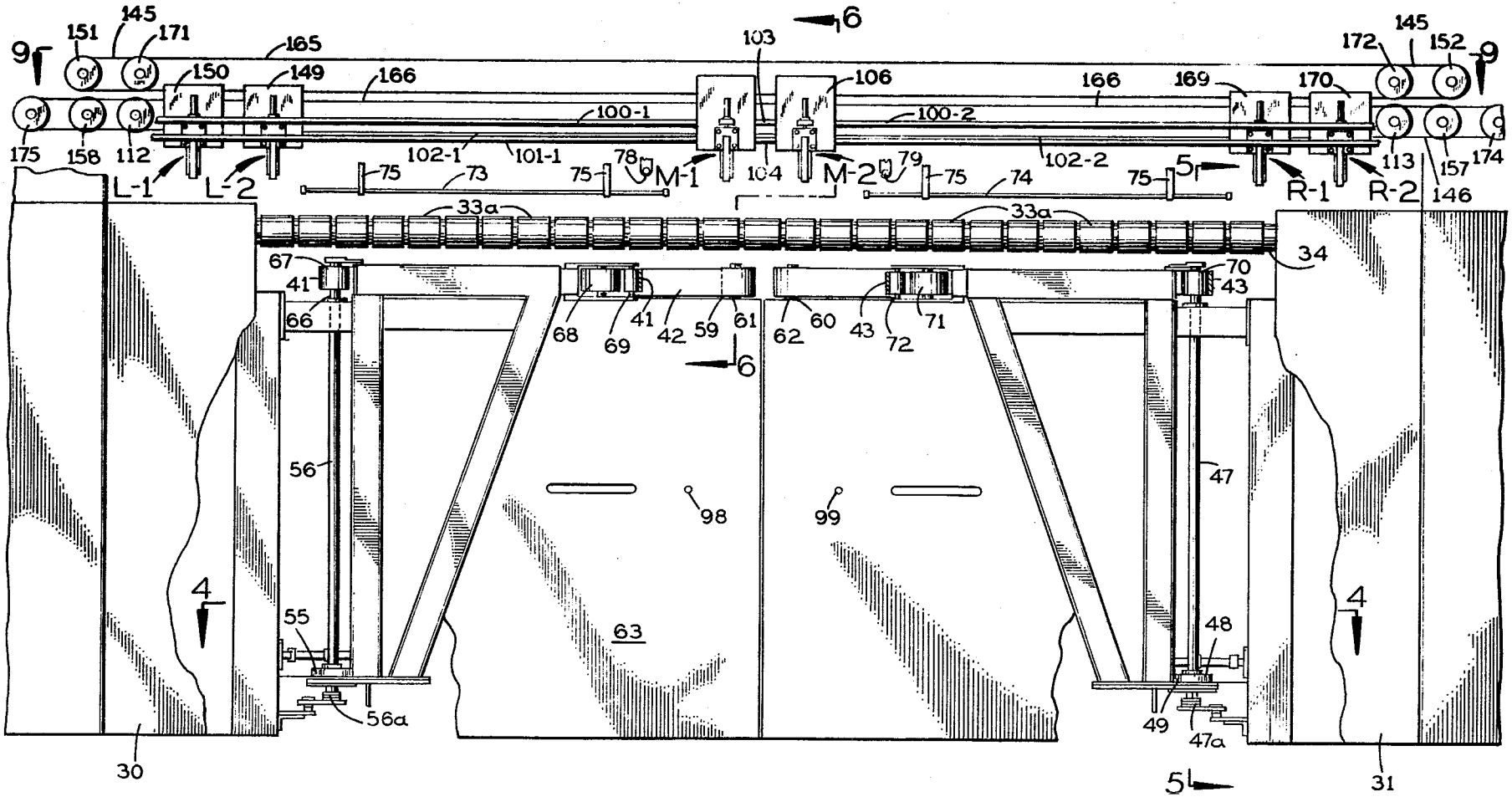
FIG. 2 is a front elevational view of this apparatus with certain parts broken away for clarity.

The vertical shafts 47 and 56 which carry the belt drive rollers 46 and 45, respectively, have their lower ends rotatably supported by bearings **47*a* and 56*a* carried by the apparatus framework, as shown in FIG. 2**.

The opposite ends of the horizontal, motor-driven drive shaft 51 are rotatably supported by respective bearings 57 and 58 (FIG. 4) carried by the end cabinets 30 and 31 of the apparatus framework.

At the laterally inward ends of the belt 42 and 44, idler rollers 59 and 60 are rotatably mounted on respective vertical posts 61 and 62 (FIG. 1), which extend up from a vertical transverse wall 63 of the apparatus framework, as shown in FIG. 2.

The apparatus framework also has a pair of upstanding vertical transverse walls 64 and 65 (FIG. 1), one on each side of the longitudinal centerline, which are offset behind the transverse wall 63 (i.e., toward the entry side of the apparatus). The left transverse wall 64 at its laterally outward end supports an upstanding vertical post 66 on which is rotatably mounted a roller 67 for engaging the belt 41 at its left end. A larger diameter roller 68 and a small diameter roller 69 are similarly supported by the left transverse wall 64 near its laterally inward end, as shown in FIG. 2. The belt 41 extends around these rollers as shown in FIG. 3. In the like manner the right transverse wall 65 supports a roller 70 near its laterally outward end and large and small diameter rollers 71, 72 near its inner end. The belt 43 extends around rollers 70, 71 and 72 as shown in FIG. 3. Gears 48*a* 48*b* mounted on shafts 56 and 47 drive gears 49*a* and 49*b* on shafts supporting rollers 67 and 70 below pulleys 48 and 55 as shown in FIG. 5.

Figure 15:
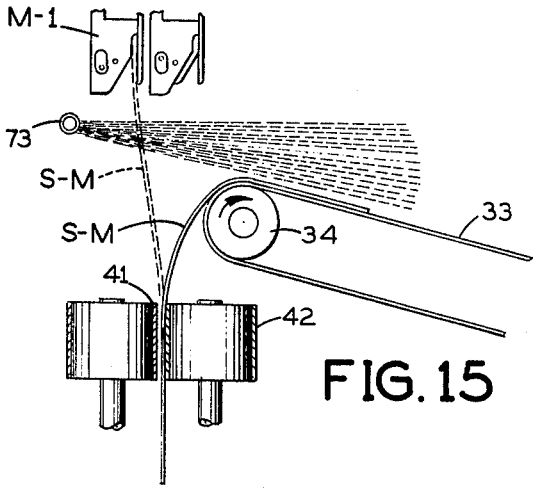
FIG. 15 is a fragmentary vertical section showing one of the air tubes in the apparatus blowing the leading end of a flatwork piece onto a conveyor after the clamps have released it.

A pair of elongated air tubes 73 and 74 extend horizontally above the level of the conveyor 33 at the entry side of the apparatus, as best seen in FIG. 1. These air tubes are positioned rearward beyond conveyor 33, (as shown for tube 73 in FIG. 6) at about the same rearwardly offset position as the small rollers 69 and 72 for the rear spreader belts 41 and 43, respectively. Each air tube has a plurality of openings spaced apart along its length in its front side for directing jets of air forward across the top of conveyor 33, as shown in FIG. 15. Vertical straps 75 (FIG. 6) suspend the air tubes below a cross piece 76 of the top carriage 32 of the apparatus framework. Flexible hoses 77 connect the air tubes 73 and 74 to a suitable source of pressurized air through normally-closed solenoid valves.

The apparatus has three pairs of sheet clamps at the entry side, each pair served by an individual machine operator whose job is to insert the adjacent corners on the upper end of a sheet into her pair of clamps, after which the apparatus will spread these clamps apart laterally from the middle of the apparatus to the left and right respectively, to spread the upper (leading) end of this sheet, as explained hereinafter. The three pairs of clamps are operated one at a time and they act on different sheets. Normally, the three pairs of clamps are positioned at the middle, left end and right end of the apparatus. The middle clamps are designated M-1 and M-2 in FIG. 1, the left end clamps are designated L-1 and L-2, and the right end clamps are designated R-1 and R-2.

Figure 13:
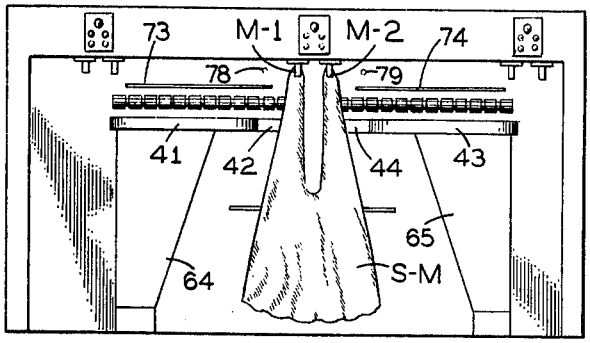
FIG. 13 is a front elevational view showing a sheet inserted in the middle pair of clamps.
Figure 17:
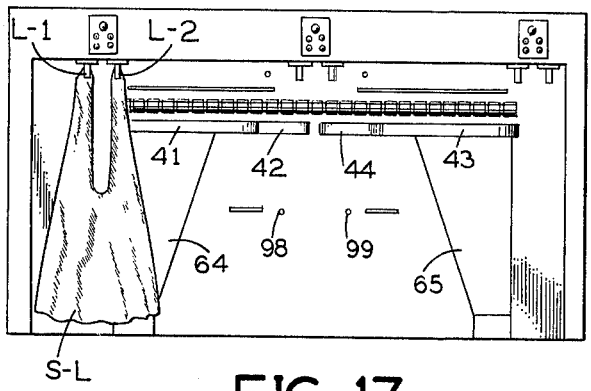
FIG. 17 is a view similar to FIG. 16 after the preceding flatwork piece has been completely fed onto the conveyor and before the left end pair of clamps are moved over to the middle of the apparatus.
Figure 14:
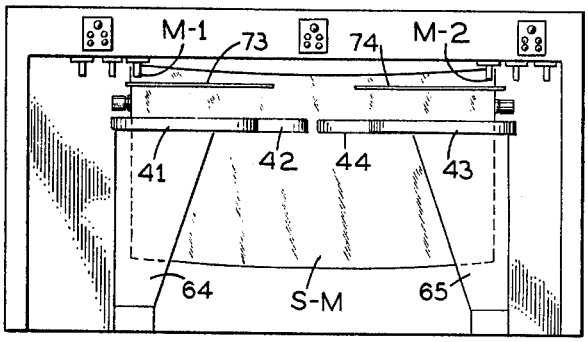
FIG. 14 is a front elevational view showing the middle clamps spread apart.

The apparatus has a novel arrangement for performing the following operations separately, one after another:

(1) After the corners of one sheet S-M are inserted in the clamps M-1 and M-2 of the middle pair (FIG. 13) clamp M-1 is moved horizontally to the left and clamp M-2 is moved horizontally to the right, carrying the respective adjacent corners of this sheet away from each other to spread the top edge of the sheet (FIG. 14). The trailing part of the sheet hanging down from these clamps is engaged between the spreader belts 41 and 42 (to the left) and between the spreader belts 43 and 44 (to the right), and the direction of movement of these spreader belts is such that this trailing part of the sheet is spread to the left and to the right on opposite sides of its centerline between its clamped upper corners.

The clamps M-1 and M-2 release the respective corners of this sheet after these clamps stop at their outermost positions to the left and right, respectively, as shown in FIG. 14. After this time the air tubes 73 and 74 discharge blasts of air to force the just-released, spread open leading end of the sheet down onto the forwardly-advancing upper run of conveyor 33 (FIG. 14). The timing of the release of the sheet by the clamps and the discharge of air by the air tubes 73 and 74 is under the control of a pair of photoelectric sensors 78 and 79 (FIG. 13) which are to the left and right, respectively, of the starting positions of clamps M-1 and M-2. As both clamps move laterally outward, the top edge of the sheet S-M moves past both sensors 78 and 79, which sense the rising middle part of the sheet's top edge. An adjustable time delay is provided between this sensing and the stopping of the laterally outward movement of the clamps. This allows for adjusting the tension on the sheet. The clamps open to release the sheet after they reach their outermost positions, provided the spacing between successive sheets is sufficient. After another adjustable time delay following the opening of the clamps, the air tubes 73 and 74 are supplied with pressurized air for an adjustable time interval to blow the just-released sheet onto the conveyor 33.

The conveyor 33 pulls the trailing part of the sheet S-M up between the paired spreader belts 41-42 and 43-44, and these paired belts continue to spread the sheet S-M laterally outward in each direction as it is drawn up between them.

Figure 16:
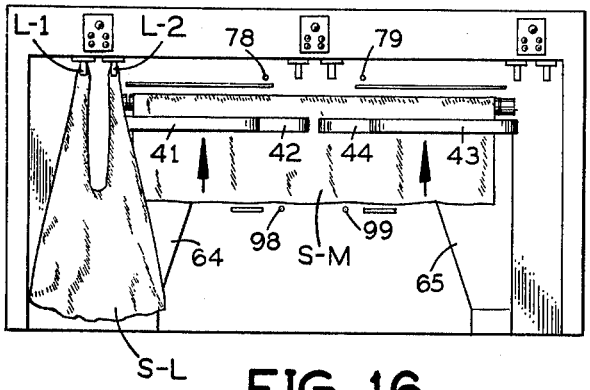
FIG. 16 is a front elevational view showing a flatwork piece inserted in the left end pair of clamps while the preceding flatwork piece is still being fed onto the conveyor.

(2) The corners of another sheet S-L are inserted in the clamps L-1 and L-2 at the left end of the machine by an operator there (FIG. 16). This may be done any time the clamps are at this feed station.

When the middle clamps start returning to the middle station the left clamps L-1 and L-2 are actuated to move in unison to the right, carrying their sheet S-L across the rear of the upstanding left transverse wall 64 of the apparatus framework and the rear spreader belt 41 on that side until they reach the centered position (FIG. 18) where they stop.

Figure 19:
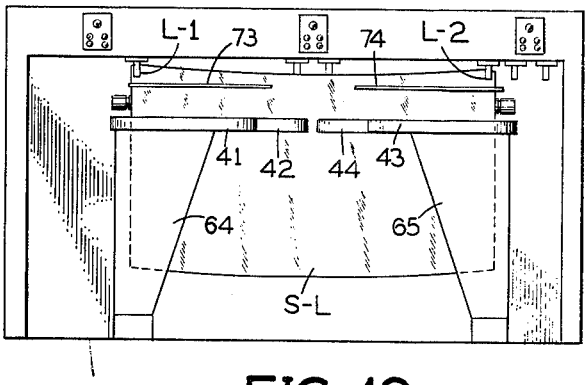
FIG. 19 is a front elevational view showing the left end clamps spread apart.

Upon the movement of the trailing edge of the preceding sheet up past the sensors 98 and 99 or the end of a minimum pause interval, whichever occurs later, the clamp L-1 now is moved horizontally to the left and clamp L-2 is moved horizontally to the right (FIG. 19).

The same operation now takes place on this sheet S-L as has been described in detail for the sheet S-M acted on by the middle clamps M-1 and M-2.

(3) The corners of a third sheet S-R are inserted in the clamps R-1 and R-2 at the right end of the apparatus by the operator there.

When the left clamp L-2 starts returning to the left station, the right clamps R-1 and R-2 are moved in unison to the left to the centered position, carrying their sheet across the rear of the upstanding transverse wall 65 of the apparatus framework and the rear spreader belt 43 on that side.

After pausing at the middle for a minimum pause interval or after a time delay following the uncovering of sensors 98 and 99 by the trailing edge of the immediately preceding sheet, whichever is longer, clamp R-1 is moved to the left and clamp R-2 is moved to the right. These clamps spread apart the top corners of this sheet S-R and pass the trailing part of the sheet between the paired spreader belts 41-42 and 43-44.

The same operation now takes place on this sheet S-R as has been described in detail for the sheet S-M acted on by the middle clamps M-1 and M-2.

It is to be understood that the apparatus follows a "demand" sequence of operation. That is, the order in which the respective sets of clamps are operated depends upon the order in which the machine operators signal their readiness after inserting their respective sheets in the corresponding paired clamps.

FIGS. 7 and 8 show one of the six sheet clamps in detail. Since all of the clamps are identical, it is to be understood that the description of one will suffice for all of them.

Referring to FIG. 7, each clamp assembly has a rigid frame which includes a vertical plate 80 at the rear (facing toward the entry side of the machine) and a smaller vertical plate 81 at the front (FIG. 8) facing into the machine. This rigid frame rotatably supports between the plates 80 and 81 a left-hand pair of upper and lower grooved rollers 82 and 83 (FIG. 7) and a right-hand pair of upper and lower grooved rollers 84 and 85.

The rear plate 80 of the clamp assembly carries a bracket 86 (FIG. 7) on the outside which supports an air cylinder 87 from below. An upwardly spring-biased piston, slidably mounted in this air cylinder, has a downwardly projecting piston rod 88 which is connected at its lower end to the upper end of a bifurcated yoke 89. This yoke at its lower end is pivotally connected at 90 to the upper end of a downwardly extending rigid linkage arm 91. The lower end of this linkage arm is pivotally connected at 92 to a bifurcated yoke 93, which is pivoted at 94 between a pair of laterally spaced pieces 95 and 96 extending down below the rear plate 80. As shown in FIG. 8, this pivoted yoke 93 has an integral projection **93*a* whose upper end extends over against the front plate 81 when the linkage arm 91 is in its normal position (i.e., when the air cylinder 87 is not pressurized). In this position, the projection 93*a* presents a flat vertical face 93*b* for engaging a corner of the sheet S to clamp it snugly against the front plate 81. The machine operator simply slides the corner of the sheet up across the inside face of the front plate 81 and the pivoted yoke extension 93*a*** holds it clamped against the front plate.

When air pressure is introduced into the cylinder 87, the piston rod 88 moves down, forcing the pivoted linkage arm 91 down. The pivotal connection 92 between the lower end of linkage arm 91 and the pivoted yoke 93 moves down arcuately about the yoke pivot 94 as a center and rocks the yoke and its extension **93*a*** counterclockwise in FIG. 8. This releases the corner of the sheet from this clamp and permits it to drop by gravity.

FIG. 2 shows the middle clamp M-1 as being slidably mounted on a pair of upper and lower cantilevered horizontal guide rods 100-1 and 101-1, which are mounted at the left side of the machine and terminate just short of the centerline of the machine. As shown in FIG. 2, these guide rods are rigidly interconnected by a vertical connecting piece 102-1 extending between them. The upper roller 82 of middle clamp M-1 is in rolling engagement with the top of the upper guide rod 100-1, and the lower roller 83 of this clamp is in rolling engagement with the bottom of the lower guide rod 101-1.

The other middle clamp M-2 is slidably mounted on similar upper and lower cantilevered horizontal guide rods 100-2 and 101-2, which are mounted at the right side of the machine and terminate just short of the machine's centerline.

Figure 25:
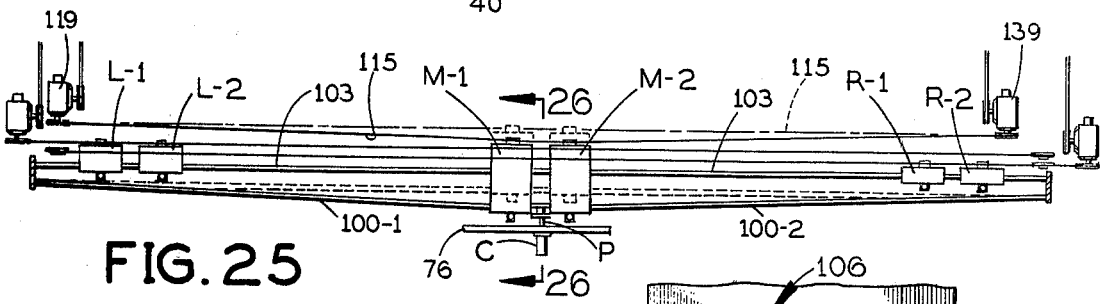
FIG. 25 is a fragmentary top plan view showing the arrangement for adjusting the middle clamps longitudinally.

The mounting of the rods 100-1, 101-1 for clamp M-1 and the mountings of the rods 100-2, 101-2 for clamp M-2 have enough play in them to permit the free ends of these rods to be displaced as much as 3 inches rearward (away from the conveyor 33) midway across the machine at its entry side. An air cylinder-andpistion unit is coupled to the adjacent free inner ends of these paired rods for effecting such displacement, when desired (FIG. 25).

The clamps L-1 and L-2 which normally are at the left end of the apparatus are similarly mounted on a single pair of horizontal guide rods 103 and 104 (FIG. 6) which extend completely across the entry side and are spaced forward (i.e., in the direction into the apparatus from its entry side) from the respective paired guide rods for the middle clamps M-1 and M-2. These guide rods 103 and 104 are interconnected by a rigid vertical piece 105 (FIG. 6).

Figures 9, 10, 11, 12:
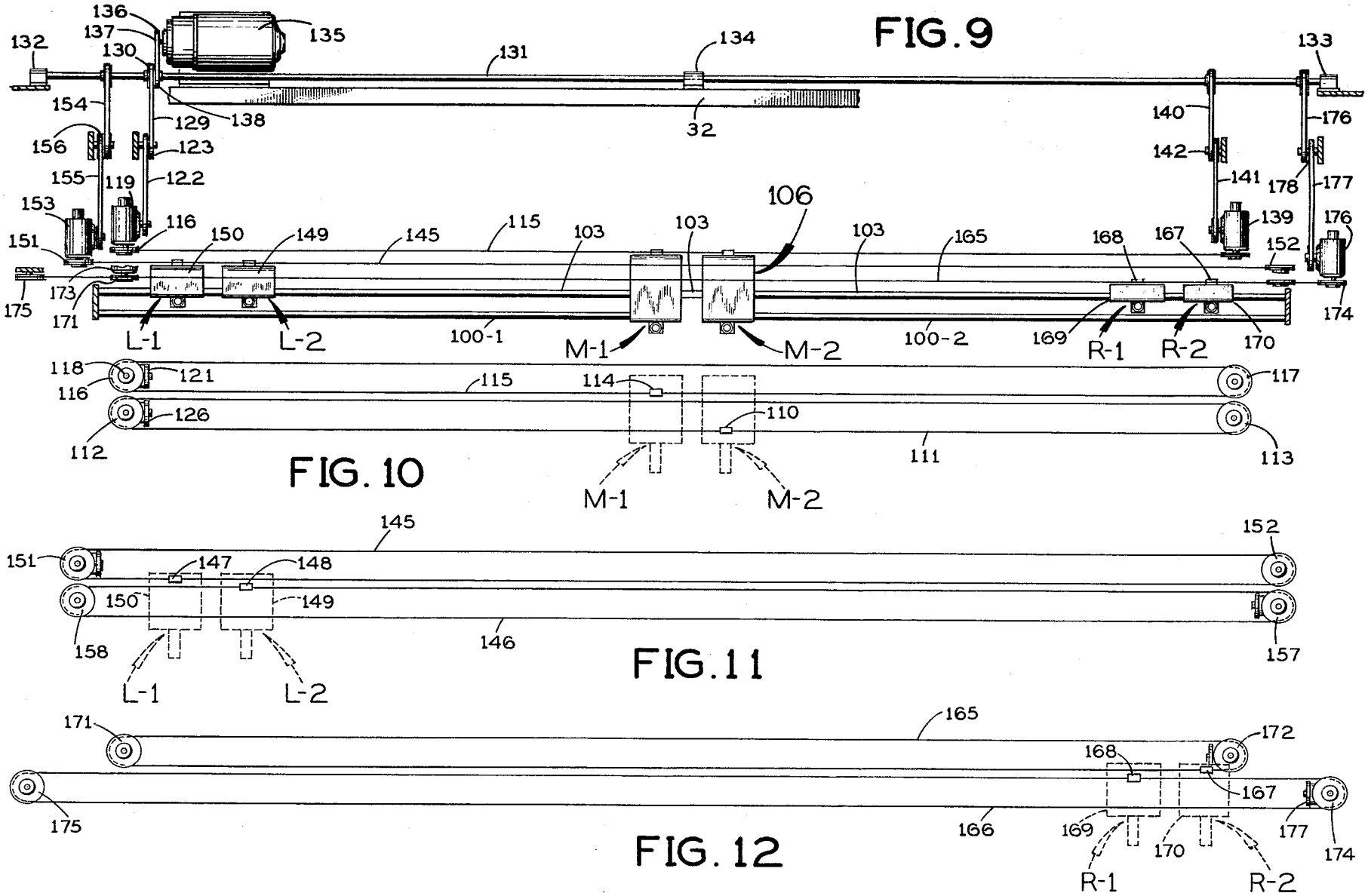
FIG. 9 is a horizontal longitudinal section taken along the line 9—9 in FIG. 2 at the top of the apparatus, with certain parts omitted and other parts simplified for clarity.
FIG. 10 is a simplified front elevational view of the cable drive for the middle pair of clamps in the present apparatus.
FIG. 11 is a simplified front elevational view of the cable drive for the left end pair of clamps in this apparatus.
FIG. 12 is a simplified front elevational view of the cable drive for the right end pair of clamps in this apparatus.

The right end clamps R-1 and R-2 are slidable on the same horizontal guide rods 103 and 104 as clamps L-1 and L-2, as shown in FIG. 9.

The two middle clamps M-1 and M-2 are coupled separately to respective flexible endless cables to be displaced from their normal position close together midway across the apparatus at its entry side to their extended positions at the left and right ends respectively, of the apparatus.

As shown in FIG. 6, clamp M-2 is carried by a generally inverted U-shaped attachment piece 106 having a vertical depending rear leg 107 fastened to the rear wall 80 of this clamp directly in front it its air cylinder 87, a horizontal top leg 108 extending forward from the upper end of the rear leg 107, and a depending front leg 109 extending vertically down from the front end of the top leg 108. A connector 110 on the lower end of the front leg 109 connects it to a horizontal cable 111, which is shown as a two-strand cable but may have multiple stands, if desired. It preferably has a plastic sheath (not shown).

As shown schematically in FIG. 10, the cable 111 is an endless flexible cable which extends from a pulley 112 at the left end of the apparatus to a pulley 113 at its right end. The connection 110 between the attachement piece 106 for the clamp M-2 and the cable 111 is made on the lower horizontal run of this cable.

The other middle pulley M-1 has a similar connection at 114 to a similar cable 115, which is located directly above cable 111 and extends around pulleys 116 and 117 located directly above pulleys 112 and 113, respectively. Pulleys 112 and 116 appear in FIG. 6.

As shown in FIG. 6, the left end pulley for the upper cable 115 is mounted on the output shaft 118 of a reversible clutch-brake unit 119 of known design, having a brake which is electrically-applied and spring-released and a clutch which is spring-engaged and electrically-released for driving an output shaft in one direction or the other. The clutch-brake unit has an input shaft 120 carrying a pulley 121 driven by a flexible endless belt 122, whose opposite end is driven by an idler pulley 123.

The idler pulley 123 is driven by a flexible endless belt 129 whose opposite end (FIG. 9) extends around a drive pulley 130. Pulley 130 is mounted on a horizontal drive shaft 131 extending transversely across the interior of the top carriage 32 of the apparatus framework and rotatably supported by bearings 132 and 133 in its opposite ends and a bearing 134 midway along its length. These bearings are supported by the top carriage 32 of the apparatus framework. Drive shaft 131 is driven by an electric motor 135 through a belt 136 and pulleys 137 and 138. As long as motor 135 is on, the drive shaft 131 is driven continuously. Normally the clutch-brake unit 119 for cable 111 is energized so that the brake is applied and the clutch is disengaged.

Referring to FIG. 10, the pulley 112 at the left end of the cable 111 for the clamp M-2 is driven through a similar clutch-brake unit 124 (FIG. 6) located directly below the aforementioned clutch-brake unit 119. The clutch-brake unit 124 has an input shaft 125 carrying a pulley 126 which is driven through a flexible endless belt 127 from an idler pulley 128 on the same shaft as the idler pulley 123 driven from shaft 131.

The two left end clamps L-1 and L-2 are coupled separately to respective flexible endless cables 145 and 146 which are located one above the other, as shown in FIG. 11. As shown in FIG. 6, this second pair of endless cables 145 and 146 is spaced behind the first pair of endless cables 111 and 115 for the middle clamps M-1 and M-2.

Clamp L-2 is attached to the upper horizontal run of the lower cable 146, as shown schematically at 148 in FIG. 11. As shown in FIG. 6, clamp L-2 is carried by a generally inverted U-shaped attachment piece 149 whose depending front leg carries the connector 148 which is secured to the upper run of cable 146. The attachment piece 149 for clamp L-2 is generally similar to the attachment piece 106 for clamp M-2 except that it is smaller.

Clamp L-1 is attached to the lower horizontal run of the upper cable 145, as shown schematically at 147 in FIG. 11. An inverted U-shaped attachment piece 150 similar to the just described attachment piece 149 for the other clamp L-2 of this pair is provided between clamp L-1 and the cable connector 147.

The upper cable 145 is driven by a pulley 151 at its left end and it extends around an idler pulley 152 at its right end. Referring to FIG. 9, the drive pulley 151 is driven through a clutch-brake unit 153 (of the type already described) from the drive shaft 131 through endless flexible belts 154 and 155 and an idler pulley 156 engaged by both these belts.

The lower cable 146 of this second pair is driven by a pulley 157 (FIG. 11) at its right end which is driven from the drive shaft 131 through a similar arrangement of a clutch-brake unit, belts and pulleys which is omitted from FIG. 9 for clarity.

The two right end clamps R-1 and R-2 are coupled separately to respective flexible endless cables 165 and 166, which are located one above the other as shown in FIG. 12 and behind the second cables 145, 146 as shown for cable 165 in FIG. 9.

Clamp R-1 is connected to the upper horizontal run of the lower cable 166 of this third pair, as shown schematically at 168 in FIGS. 9 and 12. A generally inverted U-shaped attachment piece 169, shown schematically in these Figures, carries the cable connector 168 in front and is attached to clamp R-1 in the rear in the same manner as already shown and described in detail for the middle clamp M-1.

Clamp R-2 is connected to the lower horizontal run of the upper cable 165 of this third pair, as shown schematically at 167 in FIGS. 9 and 12. A generally inverted U-shaped attachment piece 170, shown schematically in these Figures, carries the cable connector 167 in front and is attached to clamp R-2 in the rear.

The upper cable 165 is driven by a pulley 172 at its right end and it extends around an idler pulley 171 at its left end. Pulley 172 is driven from the drive shaft 131 through a clutch-brake unit, belts and pulleys which are omitted from FIG. 9 for clarity.

The lower cable 166 of this third pair is driven by a pulley 174 at its right end and it extends around an idler pulley 175 at its left end, as best seen in FIG. 12. The drive pulley 174 is driven through a clutch-brake unit 176 (FIG. 9) from the drive shaft 131 through belts 176 and 177 and an intermediate idler pulley 178.

Figure 26:
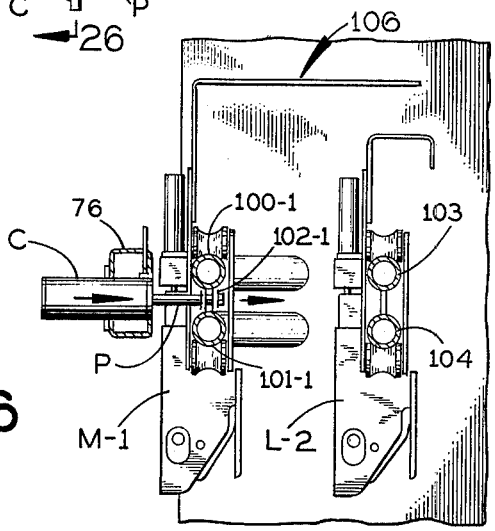
FIG. 26 is a vertical cross-section taken along the line 26—26 in FIG. 25.

In the operation of the apparatus, when the middle clamps M-1 and M-2 are at the middle of the machine and the operator there wants to insert the corners of a flatwork piece that is to be spread, the adjacent free ends of the rods 100-1, 101-1, 100-2 and 101-2 are displaced rearward about 3 inches by actuating the corresponding cylinder-and-piston unit (FIGS. 25 and 26). This puts the middle clamps closer to the operator and away from any preceding flatwork piece already in the machine. This helps particularly when the flatwork pieces are dry and liable to tangle easily. After the flatwork piece is in the middle clamps M-1 and M-2, the free ends of their guide rods 100-1, 101-1, 100-2 and 101-2 are retracted (away from the operator and toward the conveyor 33) before they are spread apart. Now the middle clamps may be moved simultaneously from the centered position (FIGS. 9, 10 and 13), where they are close together midway across the apparatus, over to the spread apart positions (FIG. 14), in which clamp M-1 is at the left end and clamp M-2 is at the right end of the apparatus, and then they are moved simultaneously back to the centered position. To move these clamps apart, the upper cable 115 is driven clockwise in FIG. 10 through its clutch-brake unit 119 and the cable 111 is driven counterclockwise through its clutch-brake unit 124 (FIG. 6). To move these clamps together, the direction of movement of their respective cables is reversed.

In the sequence of operation of the left end clamps L-1 and L-2, these clamps are moved simultaneously from their normal position close together at the left end of the apparatus, as shown in FIGS. 9, 11 and 16, over to the middle of the apparatus (still close together). This is done by driving the upper cable 145 counterclockwise in FIG. 11 through its clutch-brake unit 153 and driving the lower cable 146 clockwise through its clutch-brake unit. Thereafter, these clamps are spread apart, by driving the upper cable 145 clockwise to move clamp L-1 back to its starting position at the left end of the apparatus and driving the lower cable 146 clockwise to move clamp L-2 to the right end of the apparatus. Finally, after these clamps have released their sheet, the upper cable 145 remains stationary while the lower cable 146 is driven counterclockwise to move clamp L-2 to the left end of the apparatus, close to clamp L-1.

Figure 20:
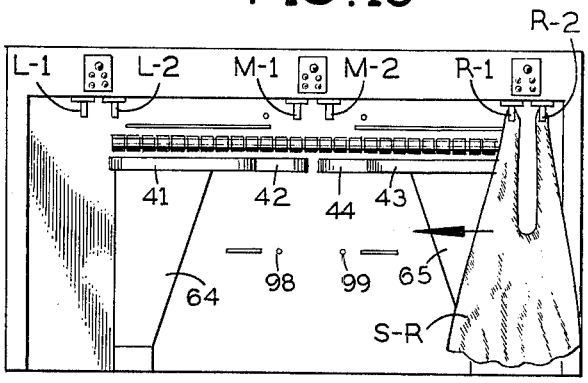
FIG. 20 is a front elevational view showing a flatwork piece inserted in the right end clamps before these clamps are moved to the middle of the apparatus prior to spreading the flatwork piece.

In the operating sequence of the right end clamps R-1 and R-2, these clamps are moved simultaneously from their normal position close to each other at the right end of the apparatus, as shown in FIGS. 9, 12 and 20, over to the middle of the apparatus (still close to each other). This is done by driving the upper cable 165 clockwise in FIG. 12 through its clutch-brake unit and driving the lower cable 166 counterclockwise through its clutch-brake unit 176 (FIG. 9). Thereafter, these clamps are spread apart by driving cable 165 counterclockwise and cable 166 counterclockwise until the clamps are at a position where the sheet is spread. The clamps are stopped here. The clamps both return to the feed station after the sheet is released.

CONTROL CIRCUIT FOR CLAMPS AT THE LEFT END

Figure 22:
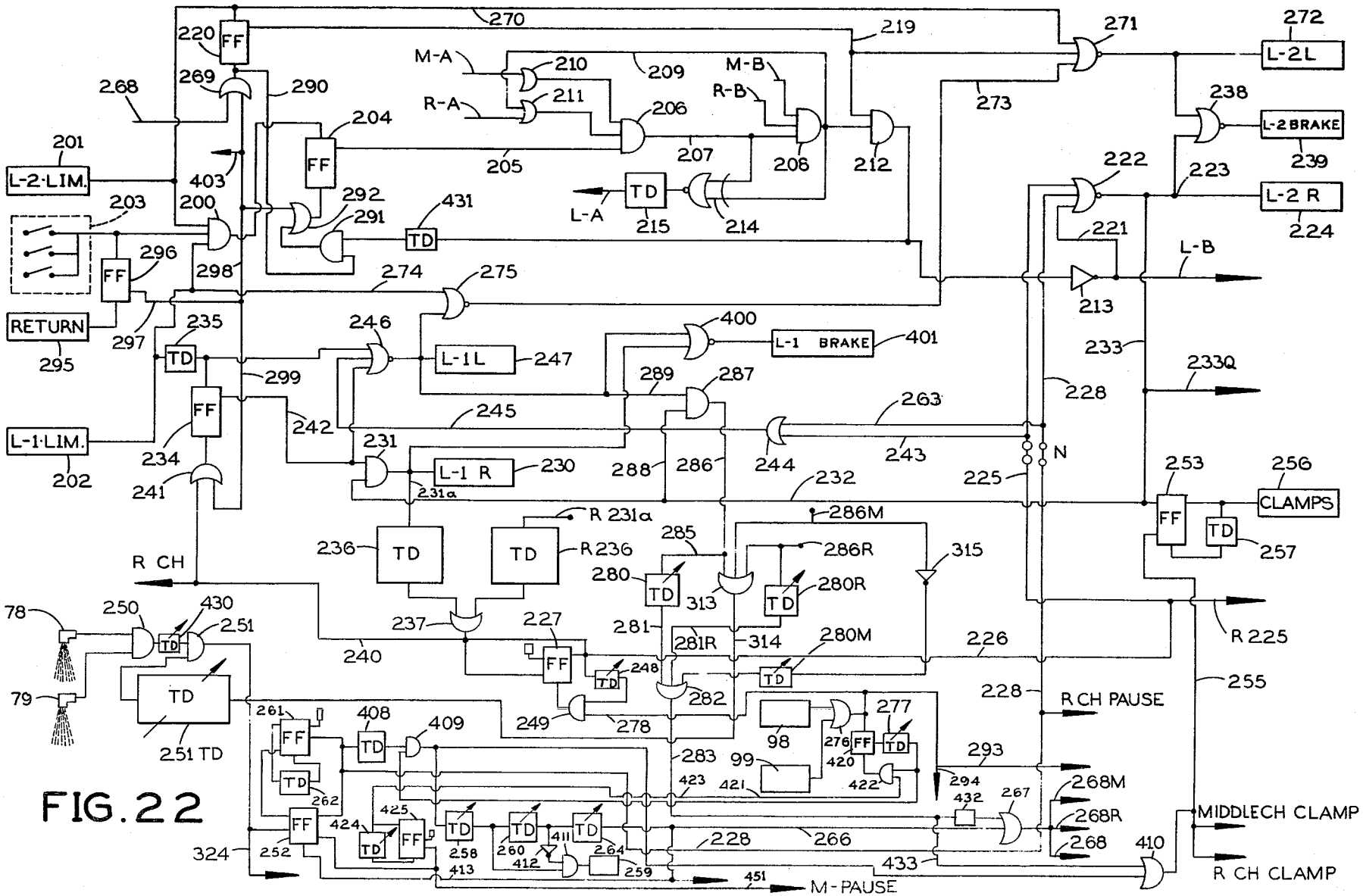
FIG. 22 is a schematic electrical circuit diagram of the control circuit for the left end pair of clamps, and including certain circuit elements which are part of the control circuits for the middle pair and the right end pair of clamps, also.
Figures 23, 24:
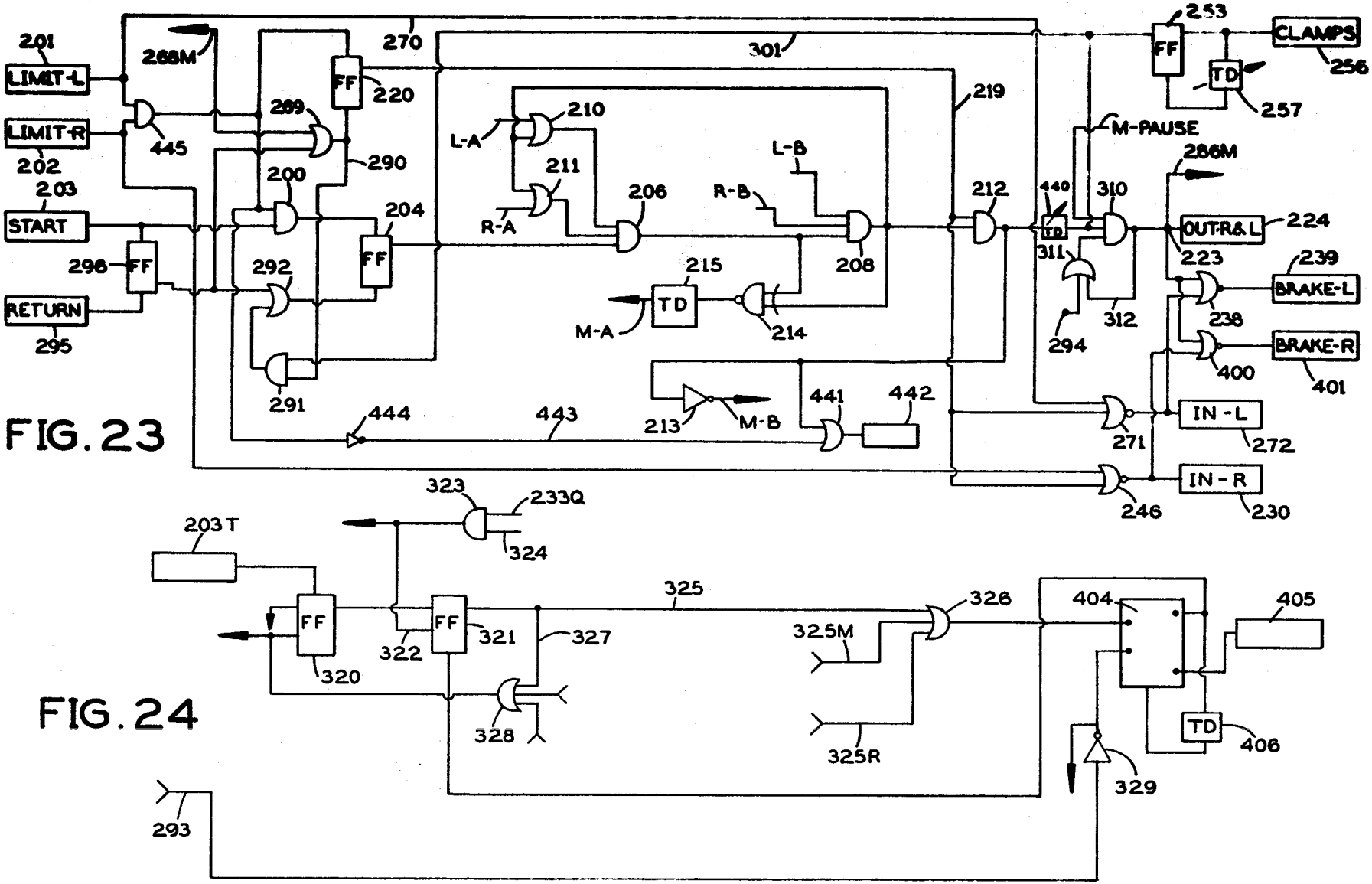
FIG. 23 is a schematic electrical circuit diagram showing part of the control circuit for the middle pair of clamps.
FIG. 24 is a schematic electrical circuit diagram showing the quality control circuitry associated with the machine.

FIG. 22 shows schematically the electrical circuit for controlling the spreading and release of the flatwork which is inserted into the left station clamps L-1 and L-2. The circuit for the flatwork inserted in the right station clamps R-1 and R-2 is the same. The circuit for the flatwork inserted in the middle clamps M-1 and M-2 is simpler and is shown in FIG. 23.

For convenience of description, the circuit elements and signals pertaining to clamps L-1 and L-2 will be referred to as being in the "left channel", and the circuit elements and signals pertaining to clamps R-1 and R-2 will be referred to as being in the "right channel", and the circuit elements and signals pertaining to clamps M-1 and M-2 will be referred to as being in the "middle channel".

Referring to FIG. 22, an AND gate 200 at the left side of this Figure is under the control of:

(1) a normally-open L-2 limit switch 201, which is closed when the inner clamp L-2 of the left pair is in its starting position to the left, as shown in FIG. 1;

(2) a normally-open L-1 limit switch 202, which is closed when the outer clamp L-1 of this pair is in its starting position, as shown in FIG. 1; and (3) a start switch 203 located at the left end of the machine for actuation by the operator there. The start switch 203 has three push buttons: "regular"; "tear"; and "stain". The latter two are for use by the operator when she detects a tear or a stain in the flatwork, in which case that flatwork will go through the present apparatus the same as a "regular" piece of flatwork having no such defect but will be rejected automatically later by equipment at the output side of the present apparatus.

When a start switch at 203 is closed while the limit switches 201 and 202 for both clamps are both closed, the AND gate 200 will set a start/return flip-flop 204 which sends an output signal via line 205 to one input terminal of an AND gate 206. Assuming that a start switch has not been closed already at either the middle channel or the right channel, the other two inputs to AND gate 206 will be high or "1", and the AND gate 206 will send an output signal via line 207 to one input terminal of an AND gate 208. Under the circumstances assumed, the other two inputs to gate 208 will be high.

The AND gate 208 now produces an output signal on a feedback line 209 which is connected to one input terminal of each of two OR gates 210 and 211. The outputs of these OR gates are, respectively, the second and third inputs to the AND gate 206, and the signal on line 209 will cause these OR gates to maintain these second and third inputs to the AND gate 206 high irrespective of the polarity of the other input signals to these OR gates. Therefore, the feedback signal on line 209 latches the AND gate 206 in the condition to which it was actuated initially by the left channel start signal on line 205.

The OR gate 210 has a second input at M-A which changes level in response to a center channel "A" signal. Similarly, the OR gate 211 has a second input at R-A which changes polarity in response to a right channel "A" signal. However, once the AND gate 206 has been latched, as described, neither a center channel "A" signal nor a right channel "A" signal can now interfere with or interrupt the left channel operation which was initiated by operating a left channel start button at 203, as described.

The left channel start signal at the output side of the AND gate 208 goes through an AND gate 212 and an inverter 213 to a line L-B.

The AND gate 208 in the left channel control circuit has two additional input lines M-B and R-B which come from the respective control circuits for the middle and right channels and which correspond to the output line L-B in the left channel circuit of FIG. 23.

ESTABLISHING PRIORITY OF OPERATION AMONG THE LEFT, RIGHT AND MIDDLE CHANNELS

If the left channel start switch was operated first, then the left channel "B" signal appearing at line L-B will inhibit the AND gate 208 in the right channel control circuit and will inhibit the AND gate 208 in the middle channel control circuit. Therefore, neither the right channel start signal nor the middle channel start signal can now get through to the output of its AND gate 208.

However, if the left channel start switch was operated second, for example, after the right channel start switch, then its AND gate 208 would be inhibited by the right channel signal at its R-B input and the signal on its input line 207 would be high and its output would be absent. These two signals are applied to the respective input terminals of an exclusive NOR gate 214 and the signal at the output of 214 will be low. After a time delay in the time delay circuit 215 this low will be applied as the left channel "A" signal on line L-A.

Line L-A is connected to an input of one of the two OR gates 210 and 211 in the right channel control circuit and the middle channel control circuit. The left channel "A" signal will not affect the previously "latched" right channel control circuit (under the conditions assumed) but it will disable the AND gate 206 in the middle channel control circuit. Thus, the second start signal (in the left channel) will now produce an "A" output signal which prevents the third start signal (in this instance, the middle channel "start" signal) from getting past the AND gate 206 in the middle channel control circuit just as the first "start" signal (in this instance, the right channel "start" signal) has produced a "B" signal which is preventing the second "start" signal (for the left channel) from passing through the AND gate 208 in the left channel control circuit.

With this arrangement, then, the first start switch that is operated (whether for the left channel, the right channel, or the middle channel) disables the operation of the second channel to have its start switch operated, and the second similarly disables the third. Therefore, even if two or all three of the operators attempt to start their respective channels at about the same time, the first one started will finish most of its operation before the second begins, and the second before the third.

Figure 18:
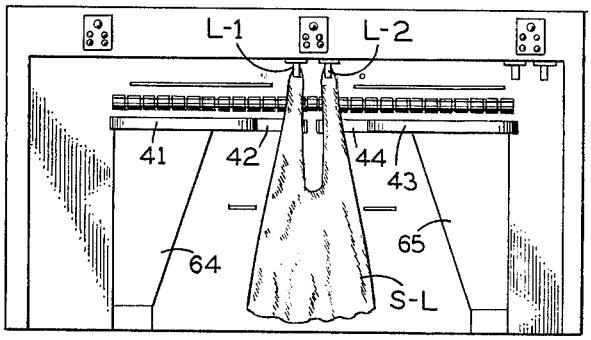
FIG. 18 is a front elevational view showing the left end clamps moved over to the middle of the apparatus.

MOVING THE LEFT CHANNEL CLAMPS L-2 and L-1 FROM THE LEFT END TO THE MIDDLE OF THE APPARATUS The AND gate 212 has a first input connected to the output of AND gate 208 and a second input via line 219 from a "forward/reverse" flip-flop 220 which will be set, provided the L-2 limit switch 201 has been operated properly. Normally this will be true, and the AND gate 212 will be enabled by the respective signals on its two inputs. The output signal from the inverter 213 is applied via line 221 to one input of a NOR gate 222, which controls the clutch-brake unit for the cable 146 (FIG. 11) which positions the inner left clamp L-2. The clockwise drive arrangement in FIG. 11 for the cable 146 which positions the inner left clamp L-2 is designated schematically by the "L-2 R" block 224 in FIG. 22. When the correct signal is established at point 223 by the NOR gate 222, this drive arrangement begins to move the inner left clamp L-2 from its normal position near the left end of the apparatus over to the right to a position at the middle of the apparatus, as shown in FIG. 18.

The signal level at point 223 also depends on two other inputs to the NOR gate 222.

One of these inputs is connected via lines 225 and 226 to a flip-flop 227, which at this time establishes a low at this input.

The third input to the NOR gate 222 is connected via line 228 to a flip-flop 252, which establishes a low at this input until both of the "stretch" sensors 78 and 79 have been operated by the sheet or other piece of flatwork.

Therefore, with the inner left clamp L-2 at its normal position (to the left) and the left channel "start" signal having come through to the NOR gate 222, the latter will establish a high at point 223 to begin driving cable 146 clockwise in FIG. 11 to move the left inner clamp L-2 to the right, toward the middle of the apparatus.

The left outer clamp L-1 begins moving to the right at the same time as the left inner clamp L-2. This is done by actuating the clutch-brake unit 153 (FIG. 9) to drive cable 145 counterclockwise in FIG. 11. This is designated schematically by the "L-1 R" block 230 at the middle left in FIG. 22.

As shown in FIG. 22, such actuation of the "L-1 R" block 230 requires an output signal of the proper level from an AND gate 231. One input of this AND gate is connected via lines 232 and 233 to the output of the NOR gate 222. A second input of this AND gate is connected via line 242 to a flip-flop 234, which is connected through a time delay circuit 235 to the L-1 limit switch 202, which is closed while the left outer clamp L-1 is in its normal position at the left end of the apparatus. Such closing of the outer limit switch 202 sets the flip-flop 234 to establish a high at the corresponding input of the AND gate 231. Then, when the correct level signal appears at point 223 for starting the left inner clamp L-2 to move in, this same signal enables the AND gate 231 to actuate the "L-1 R" block 230 for causing the left outer clamp L-1 to begin moving to the right, toward the middle of the apparatus, in unison with the left inner clamp L-2.

CLAMPS PAUSE AT THE MIDDLE OF THE APPARATUS

The clamp-actuating signal for the outer left clamp L-1 at the output of the AND gate 231 is applied to the input of a time delay circuit 236. After a time delay interval which allows the two left channel clamps L-1 and L-2 to reach the desired positions at the middle of the apparatus, this time delay circuit 236 delivers an output signal to an OR gate 237 which sets the flip-flop 227.

When this happens, the NOR gate 222 is disabled via lines 226 and 225 and the actuating signal at point 223 for the "L-2 R" drive 224 disappears. Consequently, the inner left clamp L-2 stops moving to the right. Note that this "stop" signal at point 223 is applied to one input of a NOR gate 238, causing the latter to actuate the brake 239 in the clutch-brake unit for the drive cable 146 for the left inner clamp L-2, so that this cable is braked to a stop now. (The other input to the NOR gate 238 is the same as the input at 223 at this time.)

The disabling of NOR gate 222 also removes one enabling input to the AND gate 231 ahead of the "L-1 R" drive 230.

Also, when the flip-flop 227 is set it applies a signal via line 240 to an OR gate 241 for resetting the flip-flop 234, which now removes the other enabling input for the AND gate 231 on line 242. The purpose of flip-flop 234 is to control the direction of movement of clamp L-1.

The "L-1 R" drive 230 is disabled, de-clutching the counterclockwise drive for the cable 145 in FIG. 11 which had been moving the left outer clamp L-1 to the right. At the same time the brake actuating signal at the output of NOR gate 400 is applied to the brake 401 in the clutch-brake unit 153 for cable 145, so that it is braked to a stop simultaneously with the drive cable 146 for the left inner clamp L-2.

The setting of flip-flop 227 (by the OR gate 237, as described) also applies a signal via lines 226, 225, and 243 through an OR gate 244 and line 245 to one input of a NOR gate 246. The output of this NOR gate is connected to the clutch-brake unit for the cable 145 (FIG. 11) which is indicated schematically by the "L-1 L" block 247 in FIG. 22. However, this input signal to the NOR gate 246 disables it from operating the "L-1 L" block 247 at this time. Therefore, the outer left clamp L-1 pauses at its position near the middle of the apparatus.

The inner left clamp L-2 also is under the control of flip-flop 227 via lines 226 and 225 and NOR gate 222. The "L-2 R" block 224 at the upper right will be disabled, and the clamp L-2 will stop, in response to the setting of flip-flop 227 and it will remain disabled until flip-flop 227 is reset.

Therefore, the outer left clamp L-1 will stop at a location just to the left of the centerline of the machine and the inner left clamp L-2 will stop at a location just to the right of this centerline.

The duration of the clamps "pause at the middle" is determined jointly by:

(1) an adjustable time delay circuit 248, which begins to time out in response to the setting of flip-flop 227; and (2) the actuation of either trailing edge sensor 98 or 99 by the immediately preceding sheet (which has already been released by its clamps and blown onto conveyor 33).

The output of time delay circuit 248 is connected to one input of an AND gate 249, whose output is connected to a reset terminal of flip-flop 227. AND gate 249 has a second input via line 278 from the output side of an OR gate 276. The trailing edge sensors 98 and 99 are connected to the respective input terminals of OR gate 276, so that an enabling signal for AND gate 249 appears on line 278 immediately after the trailing edge of the preceding sheet moves up past the trailing edge sensors 98 and 99.

The time delay circuit may be set to time out after 0.1 or 0.2 second, typically, and this determines the minimum duration of the clamps' pause at the middle. For example, if there is no preceding piece of flatwork in the machine or if it is a short piece, the pause at the middle will be determined by the time delay circuit 248. Usually, however, there will be a preceding flatwork piece being pulled forward by the conveyor 33, but with its trailing edge not yet past the trailing edge sensors 98 and 99. In that case, the AND gate 249 will not be enabled until substantially immediately after the trailing edge of the preceding flatwork piece moves up past the trailing edge sensors 98 and 99.

MOVEMENT OF CLAMP L-1 FROM THE MIDDLE TO THE LEFT

MOVEMENT OF CLAMP L-2 FROM THE MIDDLE TO THE RIGHT

When the flip-flop 227 is reset its output signal via lines 226, 225 and 243, the OR gate 244 and the line 245 enables the NOR gate 246. A second input to this NOR gate is connected to the output line 242 from flip-flop 234 (which is unaffected by the setting of flip-flop 227). A third input to the NOR gate 246 is from the L-1 limit switch 202, and this input now is low. All input signals to the NOR gate 246 are low, thus enabling it, and its output now actuates the "L-1 L" block 247, so that the cable 145 is now driven clockwise in FIG. 11 to move the outer left clamp L-1 from near the middle of the apparatus back over to the left.

The resetting of the flip-flop 227 after the time delay also enables the NOR gate 222 again via lines 226 and 225, so that the "L-2 R" block 224 is actuated again and the "L-2 Brake" block 239 is disabled. Consequently, the clockwise drive to the cable 146 for the inner left clamp L-2 in FIG. 11 is re-established and this clamp again begins moving to the right (from near the middle of the apparatus toward its right end).

STOPPING THE OUTWARD MOVEMENT OF CLAMPS L-1 AND L-2

When the top edge of the flatwork held by the two outwardly-moving clamps L-1 and L-2 moves up past the respective "stetch" sensors 78 and 79, these sensors (at the lower left corner in FIG. 22) enable an AND gate 250 and, after a time delay in an adjustable delay circuit 430, enable an AND gate 251 to trigger a flip-flop 252. A time delay circuit 251 TD also controls the AND gate 251 to prevent the flip-flop 252 from being triggered by the movement of the clamps L-1 and L-2 past these sensors. Beginning when the clamps start moving apart until the time delay in circuit 251 TD has been completed, the "stretch" sensors are inoperative in effect because the AND gate 251 is disabled. The triggering of flip-flop 252 causes NOR gate 222 to be disabled via line 228. This action of NOR gate 222 disables the "L-2 R" block 224 and enables the "L-2 Brake" block 239. Therefore, the movement of the inner left clamp L-2 to the right is stopped.

Also, this disabling signal on line 228 is applied via line 263 through the OR gate 244 line 245 to the NOR gate 246, disabling the latter so as to disable the "L-1 L" block 247 and enable brake block 401. Therefore, the movement of the outer left clamp L-1 to the left also is stopped.

FLATWORK RELEASED BY CLAMPS L-1 AND L-2 AND BLOWN ONTO CONVEYOR 33

The output of flip-flop 252 is connected through a 0.2 second time delay circuit 408 to one input terminal of an AND gate 409. The other input terminal of AND gate 409 is connected to the output of a sheet overlap time delay circuit 277 associated with a flip-flop 420 at the output side of OR gate 276. Flip-flop 420 is set in response to the actuation of the trailing edge sensors 98 and 99, as described, and circuit 277 begins to time out. Assuming that the spacing between the leading (top) edge of the present sheet and the trailing (bottom) edge of the immediately preceding sheet is sufficient, so that time delay circuit 277 has timed out, the AND gate 409 will be enabled 0.2 second after the flip-flop 252 has been triggered in response to the "stretch" sensors 78 and 79.

The output of AND gate 409 is connected to an OR gate 410 (at the lower right in FIG. 22), which is enabled in response to the enabling of AND gate 409. The output of OR gate 410 is connected via line 255 to flip-flop 253, so that flip-flop 253 is operated in response to the enabling of OR gate 410. When this happens, flip-flop 253 actuates the clamps L-1 and L-2 to release the sheet. (This is done through the air cylinder 87 for each clamp, as already explained.) The clamp-release circuitry is designated schematically by the block 256 in FIG. 22. A time delay circuit 257 associated with the flip-flop 253 restores it after a suitable time interval so as to restore the clamps to their normal condition following their release of the sheet.

The time interval between the operation of the stretch sensors 78 and 79 and the release of the sheet depends upon the adjustment of the time delay circuit 430. This adjustability of this time interval enables the tension on the sheet between the clamps at the time of its release to be adjusted.

The AND gate 409 also controls the actuation of the air tubes 73 and 74 for blowing onto the conveyor 33 the flatwork piece which has just been released by the left clamps L-1 and L-2. The output of AND gate 409 is connected through an adjustable time delay circuit 258 to one input terminal of an AND gate 411. This AND gate has a normally-enabled second input terminal which is connected to the output of inverter 412. After the time delay set by circuit 258, following the enabling of AND gate 409, the AND gate 411 is enabled. The output of AND gate 411 is connected to a block 259, which designates schematically the air tubes 73, 74 and their electro-pneumatic controls.

The duration of the air blasts from these air tubes is determined by an adjustable time delay circuit 260, which is connected between the output of the time delay circuit 258 and the input of the inverter 412. After the time delay determined by circuit 260, the AND gate 411 is disabled via the inverter 412.

A repeat operation of the air tubes 73 and 74, in the event that the flatwork vibrates back and forth in front of the "stretch" sensors 78 and 79, is prevented by a flip-flop 261. A time delay circuit 262 associated with the flip-flop 261 causes the latter to prevent the flip-flop 252 from being triggered a second time from the "stretch" sensors 78 and 79. The time delay interval established by the time delay circuit 262 may be 2 seconds, for example.

The output of the time delay circuit 260 also is connected to the input of an adjustable time delay circuit 264, whose output is connected via line 413 to flip-flop 252 to reset the latter after circuit 264 times out.

The previously-mentioned sheet overlap time delay circuit 277 also has its output connected to one input of an AND gate 422 for resetting the flip-flop 420. This AND gate has a second input via line 421 from the output side of a time delay circuit 424 associated with a flip-flop 425. Upon the resetting of flip-flop 252, flip-flop 425 causes delay circuit 424 to start timing out for a short period, such as 0.1 second, during which interval it enables the AND gate 422 to reset flip-flop 420. This inhibits the blowpipe from operating until the trailing edge passes sensors 98 or 99 and the "sheet overlap" time delay 277 time out.

RETURN OF CLAMP L-2 FROM RIGHT END TO LEFT END OF APPARATUS

After the time delay circuits 260 and 264 time out, the OR gate 267 is enabled via line 266 to apply a signal through a "reverse" line 268 which extends to one input of an OR gate 269. This signal through the OR gate 269 reverses the "forward/reverse" flip-flop 220, thereby making its output on line 219 low and the output from the AND gate 212 low. This signal reversal at the output of AND gate 212 produces the signal reversal at line 221 for disabling the NOR gate 222.

The reversal of the flip-flop 220 also produces an output signal on line 219 which is applied to a NOR gate 271 to actuate the "L-2 L" block 272. This block represents schematically the reversing clutch for cable 146 (FIG. 11) which now drives this cable counterclockwise in FIG. 11 to move the left inner clamp L-2 from the right end of the apparatus toward the left. The signal at the output of the NOR gate 271 at this time causes the NOR gate 238 to release the L-2 brake 239 which had been applied to hold the cable 146 stationary.

For the NOR gate 271 to be enabled by the signal on line 219, as described, its two other inputs must be "low" also. One of these is the signal on line 270, which is low unless clamp L-2 is back at its starting position. The remaining input on line 273 has the proper level if either of the following two conditions is met:

(1) the outer left clamp L-1 is back in its starting position at the left end of the apparatus, holding the limit switch 202 closed and thereby providing the proper signal polarity on the input line 274 to a NOR gate 275 whose output is connected to line 273; or (2) the "L-1 L" block 247 is energized, which means that the outer left clamp L-1 is moving to the left.

ENABLING NEXT CHANNEL TO OPERATE

The clamps for the next channel cannot move until the inner left clamp L-2 begins its return from the right end of the apparatus over to its starting position at the left end. This happens, as described, in response to a "reverse" signal on line 268.

This "reverse" signal passes through the OR gate 269 and is applied via line 290 to one input of an AND gate 291. A second input to this AND gate is from the output of AND gate 212 through a time delay circuit 431. With both inputs to the AND gate 291 now high, this AND gate delivers a reset signal via OR gate 292 to reset the flip-flop 204. This disables the AND gate 205 which, in turn, disables the AND gate 208 in the channel priority circuitry in the left channel control circuit of FIG. 22. Therefore, the signal L-B at the outlet side of the inverter 213 in the left channel control circuit goes high and no longer inhibits the operation of the next channel in order. This high condition already existed. The second channel to have its start button pushed would have a low on equivalent "A" line. As this second channel started its "A" signal would go high allowing the third channel to have its start button pushed to have its signal move up to its line 207.

Consequently, if, for example, the next channel to operate is the right channel, its clamps R-1 and R-2 can now begin moving from their starting positions at the right end of the machine over to the middle of the machine because the inner left clamp L-2 will be out of their way, moving to the left.

If the next channel is the middle channel, then there is no initial movement of its clamps M-1 and M-2 to the middle of the apparatus because that is their starting position, so they immediately begin to move apart when the "overlap" time delay in circuit 277 has run out.

TRAILING EDGE DETECTED

As already explained, the operation of the left channel all this time has inhibited whichever of the other two channels (right or middle) is next in the order of operation, as determined by the order in which the respective start switches for the different channels were closed.

The trailing edge sensors 98 and 99 are connected to the respective inputs of an OR gate 276 whose output is connected through line 278 to one input of the AND gate 249. The second input of this AND gate is from the output of flip-flop 227 through the time delay circuit 248.

As already explained, the flip-flop 227 is part of the "pause at the middle" circuitry for the left channel which performs this control function for the clamps L-1 and L-2 after they have moved together from the left over to the middle of the apparatus during the time period established by the time delay circuit 236.

FIG. 22 shows a second time delay circuit R 236 connected to the input of flip-flop 227 through the OR gate 237. R 236 is part of the right channel control circuit (which is identical to the left channel control circuit) and it has its input connected to a line R 231*a* in the right channel circuit which is the counterpart of line 231*a* in the left channel circuit.

If the right channel is in operation before the left channel flatwork has moved up past the trailing edge sensors 98 and 99 (which is possible because the right channel clamps R-1 and R-2 can begin moving to the left from their starting position at the right end toward the middle of the apparatus), there will be an enabling signal on line R 231*a* in the right channel control circuit. This starts the time delay circuit R 236, which times out after an interval long enough for the right channel clamps R-1 and R-2 to have moved over to the middle of the apparatus.

The output signal from R 236 now operates the flip-flop 227 the same as it was operated by the output signal from the corresponding left channel time delay circuit 236. After the "pause at the middle" interval determined by the time delay circuit 248, the latter delivers an enabling signal to one input of the AND gate 249. A second enabling signal at the other input of this AND gate appears on line 278 in response to both trailing edge sensors 98 and 99 being uncovered by the previous piece of flatwork being fed.

Therefore, with the right channel clamps R-1 and R-2 at the middle of the apparatus, the flip-flop 227 will be reset through the AND gate 249 in response to the movement of the left channel flatwork up past the trailing edge sensors 98 and 99. This operation of the flip-flop 227 produces a signal on line 226 and the branch line R 225 in the right channel control circuit which is the counterpart of line 225 in the left channel control circuit of FIG. 22. In response to this signal on line R 225, the right channel clamps R-1 and R-2 will move out to the left and right from their pause position at the middle of the apparatus so as to spread the leading edge of the right channel flatwork. The foregoing description assumed that the right channel was next to operate after the left channel.

However, if the middle channel is next to operate after the left channel, then the flip-flop 227 will not be operated by the right channel time delay circuit R 236 as just described. Instead, the signal from the trailing edge sensors 98 and 99 will be applied via line 294 to the middle channel control circuit (FIG. 23). The two middle channel clamps M-1 and M-2 start at the middle of the apparatus, and after this signal appears on line 294, indicating that the trailing edge of the left channel flatwork has moved up past the trailing edge sensors 98 and 99, these middle clamps can be spread apart, as explained hereinafter with reference to FIG. 23.

The output signal from OR gate 276 also is applied to a line 293 leading to a flatwork quality control circuit (FIG. 24).

MISFEED

If a piece of flatwork was not inserted in the left channel clamps L-1 and L-2, or has dropped out of either or both of these clamps, if the diagonally opposite corners are fastened in the clamps, then one or both of the "stretch" sensors 78 and 79 will not be actuated as the clamps move out from the middle of the apparatus to the left and right, respectively. Therefore, these sensors cannot trigger the stopping of the outer left clamp L-1 and the reversal of the inner left clamp L-2, as previously described.

This control function will be achieved through a left channel misfeed time delay circuit 280 (at the lower middle of FIG. 22), whose output 281 is connected to one input of an OR gate 282. The output 283 of this OR gate is connected through a time delay circuit 432, which provides a 0.1 second time delay, to one input of the previously mentioned OR gate 267. As already explained, the output of OR gate 267 is connected via line 268 and OR gate 269 to the "forward/reverse" flip-flop 229 for reversing the direction of the inner left clamp L-2.

Also, the output of OR gate 282 is connected via lines 283 and 433 to one input of OR gate 410, so that the clamps will release the sheet immediately upon the enabling of OR gate 282 (and slightly before the clamp movements are reversed.)

The input of the left channel misfeed time delay circuit 280 is connected via lines 285 and 286 to the output of an AND gate 287. One input 288 of the AND gate 287 is connected via lines 232 and 233 to the output 223 of the NOR gate 222. The other input 289 of the AND gate 287 is connected to the output of the NOR gate 246.

With this arrangement, the AND gate 287 is enabled while the outer left clamp L-1 is moving out to the left and the inner left clamp L-2 is moving out to the right. This starts the time delay circuit 280, and after a time interval long enough for the two clamps to have moved substantially all the way out, this delay circuit produces an output signal at 281 which goes through OR gate 282, time delay circuit 432 and OR gate 267 to line 268 for reversing the flip-flop 220. This reversal of flip-flop 220

(1) disables the NOR gate 222 (as described in the section headed "Return of Clamp L-2 from Right End to Left End of Apparatus") to disable the L-2R drive 224 and actuate the L-2 brake 239, thereby preventing the inner left clamp L-2 from continuing to move out to the right, and (2) enables the NOR gate 271 after a required pause to actuate the "L-2 L" block 272, for reversing the drive to the inner left clamp L-2 so as to bring it back to the left end of the apparatus.

At the same time, the outer left clamp L-1 in moving to the left will have closed its limit switch 202, thereby disabling the NOR gate 246 and stopping the "L-1 L" drive 247 so that the outer left clamp L-1 will stop moving out to the left.

When the leftward-moving inner left clamp L-2 closes its limit switch 201, this disables the OR gate 271 and de-energizes the "L-2 L" drive 272 for cable 146 in FIG. 11. At the same time, the NOR gate 238 is enabled for operating the brake 239 for this cable.

Consequently, both clamps L-1 and L-2 are now stopped at their starting positions at the left end of the apparatus.

The right channel control circuit has a time delay circuit 280R in FIG. 22, with its input from a line 286R extending from the output of an AND gate corresponding to AND gate 287, and its output on line 281R going to a second input of OR gate 282.

CLAMP RETURN

The operator may bring back her clamps after she has operated one of her start buttons. Assuming that she decides to do this after the clamps L-1 and L-2 for this flatwork have been displaced from their starting positions at the left end of the apparatus, when she momemtarily closes the "return" switch 295 in FIG. 22, this resets the "start/return" flip-flop 296.

This flip-flop, via lines 297 and 298 enables OR gate 269, which resets flip-flop 220. Through the NOR gate 271 the flip-flop 220 now actuates the "L-2 L" block 272 to bring the inner left clamp L-2 back to the left.

Flip-flop 296 also resets flip-flop 234, via lines 297 and 299 and OR gate 241, to actuate the "L-1 L" block 247 to bring the outer left clamp L-1 back to the left.

The operation of the "return" switch 295 also cancels out any quality control designations (i.e., "Tear" or "Strain") which the operation may have included by the signal on line 403 to the quality control section (FIG. 24).

Also, the operation of the "return" switch causes the clamps to release the sheet which had been inserted by the operator. This is effected through circuitry which does not appear in FIG. 22.

Also, the machine may be provided with a "stop" switch which causes all three pairs of clamps to release their respective sheets.

MIDDLE CHANNEL CONTROL CIRCUIT

FIG. 23 shows schematically the control circuit for the middle clamps M-1 and M-2. Elements in this Figure which correspond to those in the end channel control circuit of FIG. 22 are given the same reference numerals, and the detailed description of these elements and their functions will not be repeated.

FIG. 23 is substantially simpler than FIG. 22 because the clamps M-1 and M-2 have less complicated movements. They are either both stationary at the middle, or moving apart, or stationary near the opposite ends of the apparatus, or moving toward each other. They do not move in the same direction at any time. As a consequence, the control circuitry for these middle station clamps is substantially simpler than the control circuitry for either pair of end channel clamps.

With both middle clamps M-1 and M-2 at their middle positions, the limit switches 201 and 202 in FIG. 23 will be closed, thereby enabling an AND gate 445 which triggers a flip-flop 220 to provide an enabling signal on line 219 leading to one input of an AND gate 212.

When the operator now presses one of the three push buttons for the start switch at 203, the AND gate 200 will be enabled and will set the "forward/stop" flip-flop 204. This flip-flop will enable the AND gate 206, provided there is no inhibit signal at the L-A input to OR gate 210 or at the R-A input to OR gate 211. The output from AND gate 206 will enable the next AND gate 208, provided there is no inhibit signal on the latter's L-B input or R-B input. The AND gate 208 now provides a second enabling input to the AND gate 212, so that AND gate 212 now is enabled (provided both middle clamps are properly positioned at the middle channel loading station).

The output from the AND gate 212 supplies one enabling input to an AND gate 310 through a time delay circuit 440, which preferably provides a time delay of about 1.2 second.

The output from the AND gate 212 also is applied through an inverter 213 to a line designated M-B, which provides the M-B inhibit input to the AND gate 208 in each of the left and right channel control circuits.

The output from AND gate 212 also is applied through an OR gate 441 to a block 442, which represents schematically the mechanism for returning the middle clamps forward toward the conveyor 33 at the entry side of the apparatus, so that the middle clamps are not rearwardly offset from the end clamps as much as they were when the operator was inserting the laundry piece into the middle clamps.

The output from the time delay circuit 440 at the output side of AND gate 212 is applied via line 301 to one input of an AND gate 291, but at this time the signal on line 290 disables the AND gate 291.

The AND gate 310 has a second input from flip-flop 252 FIG. 22 line 45 which is used to stop the flatwork in a spread out condition awaiting clamp release.

A third is from OR gate 311. One of its inputs is line 294. As already explained in the section headed "Trailing Edge Detector", a signal of the proper level appears on line 294 following the passage of the trailing edge of the preceding piece of flatwork up past the trailing edge sensors 98 and 99. Consequently, the AND gate 310 will be enabled at a time when the preceding flatwork will not interfere with, or be interfered with by, the preceding flatwork.

When the AND gate 310 is enabled it energizes the block 224 designated "out right and left" in FIG. 23. This represents the forward clutches for both cables 111 and 115 in FIG. 10, so that both clamps M-1 and M-2 now move laterally outward, to the left and right, respectively. The time delay circuit 440 has delayed this spreading of the middle clamps long enough for these clamps and their support rails to have moved forward to their operating positions.

A feedback line 312 from the output of AND gate 310 to a second input of the OR gate 311 maintains the latter enabled even after the trailing edge input signal to its first input 294 is no longer present.

The enabling of AND gate 310 also applies a signal via line 286M to one input of an OR gate 313 in the control circuitry of FIG. 22. This OR gate has a second input via line 286 from the AND gate 287 of the left channel control circuit and a third input via line 286R from the same AND gate in the right channel control circuit. Accordingly, the OR gate 313 will be enabled whenever any pair of clamps L-1 and L-2, M-1 and M-2, or R-1 and R-2, are moving apart.

The output signal from the OR gate 313 is applied via line 314 through the time delay circuit 251 TD to the AND gate 251. As already explained, the AND gate 251 is enabled in response to the actuation of both "stretch" sensors 78 and 79 when the flatwork is spread apart by the outwardly moving clamps after the time delay in circuit 251 TD has timed out.

As already explained, the actuation of the "stretch" sensors causes the outwardly-moving clamps to be operated to release the flatwork and actuates the air tubes 73 and 74 to blow the released flatwork onto the conveyor 33. When the middle channel is in operation, these control functions are effected by the circuit elements shown in FIG. 23 and described under the previous heading "Flatwork Released by Clamps . . . and Blown onto Conveyor 33".

The same is true for "Stopping the Outward Movement of Clamps". The outwardly-moving clamps M-1 and M-2 are stopped automatically by disabling block 224 in FIG. 23 and enabling blocks 239 and 401 via NOR gates 238 and 400, respectively, to apply the brakes for the M-1 and M-2 cables 115 and 111 in FIG. 10.

When the flatwork has been blown onto the conveyor there is a short adjustable pause, time delay 264 before line 268M goes high. The signal path is line 266, OR gate 267, line 268M (FIG. 22), line 268 (FIG. 23), OR gate 269, line 290, and flip-flop 220 (resetting it). Flip-flop 220 actuates the "in left" block 272 and the "in right" block 230 through NOR gates 271 and 246 in the same manner as described in detail for the left channel. The "in left" block 272 and the "in right" block 230 in FIG. 23 represents schematically the reverse clutches for the cables 111 and 115 in FIG. 10. Consequently, the direction of these cables is reversed and both clamps M-1 and M-2 are moved back toward the middle of the apparatus.

In FIG. 22, a "misfeed" time delay circuit 280M is connected to the input line 286M from the center channel circuit (FIG. 23) through an inverter 315. The output of this time delay circuit 280M is connected to a second input of the OR gate 282 for the purpose of automatically reversing the outwardly-moving middle clamps M-1 and M-2 in the event of a misfeed of the middle channel sheet. The enabling of the OR gate 282 will produce a signal on line 268M in FIGS. 22 and 23 for reversing the flip-flop 220 to reverse the drive to cables 111 and 115.

As already explained, the middle clamps and their support rails 100-1 and 100-2 are retracted to the operating (forward) position in response to the closing of start switch 203 for the middle channel.

If either middle clamp is not at its loading position along the respective support rail 100-1 or 100-2, then the retraction device 442 will be actuated through OR gate 441 from line 443 at the output side of an inverter 444. The input side of the inverter is connected to the output of an AND gate 445 having its respective inputs connected to the limit switches 201 and 202 for the middle clamps. Accordingly, the middle clamps will not be displaced rearwardly for the operator's convenience in loading them unless they are at the correct positions along their respective support rails.

Also, the middle clamps cannot begin to spread apart if either of them is not properly positioned at the middle channel loading station (holding the corresponding limit switch 201 or 202 closed), because in that event the AND gate 200 would not be enabled.

QUALITY CONTROL CIRCUIT

FIG. 24 shows a portion of the quality control circuit in the present system. As already mentioned, if the operator notices a tear or a stain in the sheet or other piece of flatwork, she may operate the correspondingly labeled pushbutton in the start switch 203 at her station. This will permit the defective flatwork to go through the present apparatus the same as a perfect piece of flatwork, but be rejected later, such as in a cross-folder at the outlet side of the present apparatus.

FIG. 24 shows the quality control circuitry pertaining to a "tear" defect in the left channel flatwork.

The block 203T represents schematically the "tear" contacts of the operator's start switch. When closed, these switch contacts set a flip-flop 320, and the output of this flip-flop is the data input of a flip-flop 321. Flip-flop 321 is set via line 322 from the output of an AND gate 323.

One input to AND gate 323 in FIG. 24 is via line 233Q in the left channel control circuit (FIG. 22) at the inlet 223 to the "L-2 R" block 224. Consequently, an enabling input appears at the input 233Q in FIG. 24 when the inner left clamp L-2 is moving to the right.

A second input to AND gate 323 is from a line 324 in FIG. 22 at the outlet side of the AND gate 251, which is enabled in response to the operation of both stretch sensors 78 and 79 when the piece of flatwork is spread.

When both these input signals are present, the AND gate 323 will be enabled and it will now set the flip-flop 321 to produce an output signal on a line 325 leading to one input of an OR gate 326. This OR gate has two other inputs, on lines 325M and 325R, which are the lines in the middle channel and right channel quality control circuitry corresponding to line 325 in the left channel quality control circuitry.

Thus, the OR gate 326 will be enabled by a "tear" input signal for the left, middle or right channel, followed by the outward movement of the corresponding clamps and operation of the "stretch" sensors 78 and 79.

The output of flip-flop 321 is applied via line 327 and an OR gate 328 to reset the flip-flop 320, so that the latter becomes ready to receive another quality control input signal.

Flip-flop 321 is maintained in its set condition until the trailing edge of this piece of flatwork is detected by the "trailing edge" sensors 98 and 99. When this happens a signal appears on lines 293 in FIGS. 22 and 24 which is inverted by an inverter 329 in FIG. 24 and sets flip-flop 404, provided a "tear" signal is present at 325, 325M or 325R. Line 407 connects the output of flip-flop 404 to the "tear" output 405 feeding the external quality control equipment. After delivering the signal, flip-flop 404 resets after 0.01 second through the time delay circuit 406 also resetting flip-flop 321 to clear it.

The operation of the "stain" channel is identical to that of the "tear" channel.

Thus, for a "tear" or "stain" signal to be delivered to the apparatus which can reject the defective flatwork, the following conditions must have occurred:

(1) the operator has closed the "tear" or "stain" start switch contacts at 203;
(2) the clamps have moved out;
(3) the "stretch" sensors 78 and 79 have been actuated; and
(4) the "trailing edge" sensors 98 and 99 have been operated.

Various structural changes and modifications may be adopted which differ from the illustrated embodiment. The conveyor 33 may be replaced by two endless belt conveyors, one after and slightly below the other. The flatwork clamps may differ from the arrangement shown, as may the spreader belt assembly. Also, the drive cables for the clamps may have their ends attached to an adjustable takeup coupling which provides the desired cable tautness.

FIGS. 25 and 26 show the cylinder and piston arrangement for displacing the middle clamps M-1 and M-2 rearward (away from the conveyor 33). This is done just before a laundry piece is inserted into these clamps, and then these clamps are turned forward (toward the conveyor 33) before being spread apart.

The operating position of the upper guide rails 100-1 and 100-2 for the respective middle clamps M-1 and M-2 is shown in phantom in FIG. 25. When idle the rails are in the rearward position. The rearwardly-displaced position of these elements is shown in full lines in this Figure.

The previously mentioned horizontal cross rail 76 at the entry side of the machine carries an air cylinder C for operating a piston and its piston rod P horizontally in a direction longitudinally of the conveyor 33. The forward end of the piston rod P is snugly but slidably coupled to the opposite sides of the vertical connecting plates 102-1 and 102-2 which respectively extend between the paired upper and lower guide rods 100-1, 101-1 and 100-2, 101-2. This coupling imparts the longitudinal push or pull of the piston rod to the adjacent, inner free ends of these guide rods. The mountings of the outer ends of these guide rods have sufficient play in them to permit their inner ends to be displaced longitudinally about 3 inches by the piston rod from the normal phantom-line position in FIG. 25, in which they extend perpendicular to the direction of the conveyor 33, rearward to the full-line position, in which they extend at slight acute angles to such perpendicularity and displace the middle clamps 3 inches farther away from the entry side of the machine. The drive cables 115 and 111 for these clamps stretch enough to permit such displacement.

Figure 21:
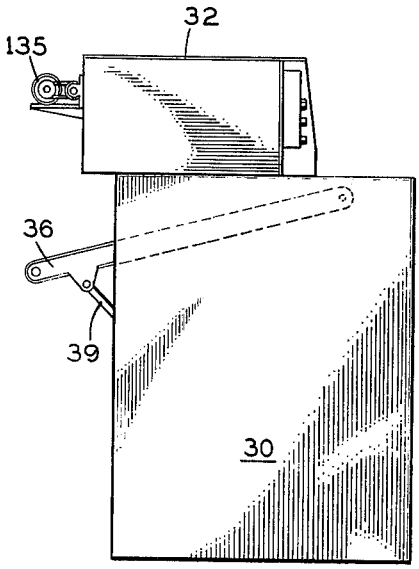
FIG. 21 is a left end elevational view.

As already mentioned the top carriage 32 of the apparatus is adjustable from the normal operating position (FIG. 1) to a forwardly retracted position (FIG. 21). This is done when an operator wants to feed laundry pieces onto the conveyor 33 manually without using the clamps and the blower tubes. The top carriage will be slid forward out of the operator's way during such manual feeding.

We claim:

1. In an apparatus having a conveyor for receiving laundry flat pieces, said apparatus including first, second and third pairs of clamps for releasably gripping respective laundry flat pieces at adjacent corners along a top edge thereof, the improvement which comprises:

means for normally positioning the first pair of clamps close to each other at a first loading station midway across the apparatus for the insertion of said corners of a first laundry piece into said first pair of clamps by a first operator stationed there;

means for spreading said first pair of clamps apart laterally in opposite directions away from the centerline of the conveyor while said first pair of clamps continue to grip said first laundry piece;

means for actuating said first pair of clamps to release said first laundry piece after said first pair of clamps have been spread apart;

means operable after the release of said first laundry piece for returning said first pair of clamps to their normal positions close to each other midway across the apparatus;

means for normally positioning said second pair of clamps close to each other at a second loading station near one end of the apparatus at one side of the centerline of the conveyor for the insertion of said corners of a second laundry flat piece into said second pair of clamps by an operator stationed there;

means for moving said second pair of clamps simultaneously from said second loading station laterally in one direction to positions close to each other midway across the apparatus while continuing to grip said adjacent corners of the second laundry flat piece;

means operable thereafter to spread said second pair of clamps apart laterally in opposite directions away from the centerline of the conveyor while said second pair of clamps continue to grip said adjacent corners of the second laundry flat piece, whereby to return one clamp of the second pair toward said second loading station while moving the other clamp of the second pair farther away from said second loading station;

means for actuating said second pair of clamps to release the second laundry flat piece after they have been spread apart;

means operable thereafter for returning said other clamp of the second pair to said second loading station close to said one clamp of the second pair;

means for normally positioning said third pair of clamps close to each other at a third loading station near the opposite end of the apparatus at the opposite side of the centerline of the conveyor for the insertion of said corners of the third laundry flat piece into said third pair of clamps by a third operator stationed there;

means for moving said third pair of clamps simultaneously from said third loading station laterally in the opposite direction to positions close to each other midway across the apparatus while continuing to grip said adjacent corners of the third laundry flat piece;

means operable thereafter to spread said third pair of clamps apart laterally in opposite directions away from the centerline of the conveyor while said third pair of clamps continue to grip said adjacent corners of the third laundry piece, whereby to return one clamp of said third pair toward said third loading station while moving the other clamp of said third pair farther away from said third loading station;

means for actuating said third pair of clamps to release said third laundry flat piece after they have been spread apart;

means operable thereafter for returning said other clamp of said third pair to said third loading station close to said one clamp of said third pair;

and means to prevent any one of said pairs of clamps from movement away from the corresponding loading station before a previously operated pair of clamps has released its laundry piece.

2. An apparatus according to claim 1, and further comprising:

separate manual start switches located respectively at said first, second and third loading stations;

and means operable in accordance with the order of operation of the respective start switches by the respective operators for causing the corresponding pairs of clamps to operate in the same order.

3. An apparatus according to claim 1, wherein:

said means for normally positioning said first pair of clamps comprises a first pair of separate flexible endless cables operatively coupled respectively to the clamps of said first pair to position the latter individually;

said means for normally positioning said second pair of clamps comprises a second pair of separate flexible endless cables operatively coupled respectively to the clamps of said second pair to position the latter individually;

said means for normally positioning said third pair of clamps comprises a third pair of separate flexible endless cables operatively coupled respectively to the clamps of said third pair to position the latter individually;

and said first, second and third pairs of cables extend transversely across said conveyor and are offset from each other longitudinally of the conveyor.

4. An apparatus according to claim 3, wherein each cable of each of said first, second and third pairs is operatively coupled individually to a corresponding reversible clutch/brake unit to have its operation controlled thereby.

5. An apparatus according to claim 1, and further comprising:

trailing edge sensor means for sensing the upward passage of the trailing edge of each laundry piece deposited on the conveyor;

and means for preventing any of said pairs of clamps from being spread apart from the respective positions midway across the apparatus until after the actuation of said trailing edge sensor means by the preceding laundry piece.

6. An apparatus according to claim 1, wherein the respective means for actuating each pair of clamps to release the corresponding laundry piece comprises a pair of stretch sensors positioned on opposite sides of the centerline of the conveyor below said clamps for respectively sensing the upward movement past said stretch sensors of the top edge of each laundry piece hanging down from a respective pair of clamps as the latter are spread apart, and further comprising:

means for blowing each laundry piece onto the conveyor after its release by the respective pair of clamps;

and time delay means acting between said stretch sensors and said means for blowing to prevent a repeat operation of the latter in the event of closely repeated operations of said stretch sensors.

7. An apparatus according to claim 1, wherein the respective means for actuating each pair of clamps to release the corresponding laundry piece comprises a pair of stretch sensors positioned on opposite sides of the centerline of the conveyor below said clamps for respectively sensing the upward movement past said stretch sensors of the top edge of each laundry piece hanging down from a respective pair of clamps as the latter are spread apart, and further comprising:

means operable, upon failure of said stretch sensors, to stop the spreading of the respective pair of clamps a predetermined time interval after such spreading begins and to bring said pair of clamps close to each other at the corresponding loading station.

8. An apparatus according to claim 1, and further comprising:

an operator's switch at each loading station operable to effect the return of either pair of clamps to the respective loading station after they have begun moving from said loading station to the middle of the apparatus.

9. An apparatus according to claim 1, and further comprising:

trailing edge sensor means for sensing the upward passage of the trailing edge of each laundry piece deposited on the conveyor;

quality control switch means at each loading station operable by the respective operator there to designate a defect in the laundry piece inserted there;

and means for storing said designation until the upward passage of the trailing edge of said last-mentioned laundry piece past said trailing edge sensor means.

10. An apparatus according to claim 1, and further comprising:

upstanding end cabinets at the opposite lateral ends of the conveyor;

and a top carriage overlying said conveyor and slidably mounted on said end cabinets for selective adjustment longitudinally of the conveyor;

said first, second and third pairs of clamps being mounted on said carriage for adjustment therewith between an operating position above the conveyor at the entry side of the apparatus and a non-operating position located forwardly along the conveyor from the entry side to permit manual spreading and feeding of laundry flat pieces onto the conveyor at the entry side.

11. An apparatus according to claim 1, wherein said means for positioning said first pair of clamps close to each other comprises:

respective cantilevered rods extending laterally inward horizontally from opposite ends of the apparatus toward the middle and slidably supporting the respective clamps of said first pair;

and means for selectively displacing said rods at the middle of the apparatus longitudinally outward away from said conveyor at the entry side of the apparatus, whereby to provide greater longitudinal clearance between said first pair of clamps and said second and third pairs of clamps when a sheet is being inserted into said first pair of clamps.

12. An apparatus according to claim 11, wherein the respective cantilever mountings of said rods at the opposite ends of the apparatus have sufficient play therein to permit the rods to be displaced longitudinally outward away from the conveyor at the entry side of the apparatus.

13. An apparatus according to claim 1, and further comprising:

an operator's switch at each loading station operable to actuate the corresponding pair of clamps to release the laundry flat piece and to effect the return of said pair of clamps to the respective loading station after they have begun moving away from said loading station to the middle of the apparatus.

14. An apparatus according to claim 1, and further comprising:

trailing edge sensor means for sensing the upward passage of the trailing edge of each laundry piece deposited on the conveyor;

quality control switch means at each loading station operable by the respective operator there to designate a defect in the laundry piece inserted there;

and means for storing said designation until the upward passage of the trailing edge of said last-mentioned laundry piece past said trailing edge sensor means.

15. In an apparatus having a conveyor for receiving a laundry flat piece, said apparatus including a pair of clamps for releasably gripping the laundry flat piece at adjacent corners along a top edge thereof, the improvement which comprises:

means for normally positioning said clamps close to each other at a loading station on one side of the centerline of the conveyor for the insertion of said corners of the laundry flat piece into the clamps by an operator stationed there;

means for moving said clamps simultaneously from said loading station laterally in one direction to positions close to each other at the middle of the apparatus while continuing to grip said adjacent corners of the laundry flat piece;

means for stopping said clamps at said last-mentioned positions;

means for maintaining said clamps stopped at said last-mentioned positions for at least a minimum pause interval;

means operable thereafter to spread said clamps apart laterally in opposite directions away from the centerline of the conveyor while said clamps continue to grip said adjacent corners of the laundry flat piece, whereby to return one of said clamps toward said loading station while moving the other clamp farther away from said loading station;

and means for actuating said clamps, after they have been spread apart, to release the laundry flat piece.

16. An apparatus according to claim 15, and further comprising:

trailing edge sensor means for sensing the upward passage of the trailing edge of each laundry piece deposited on the conveyor; and wherein:

said means for maintaining said clamps stopped is operable to do so until the expiration of said minimum pause interval or the passage of the trailing edge of a preceding laundry piece past said trailing edge sensor means, whichever is later.

17. An apparatus according to claim 16 wherein said means for normally positioning said clamps comprises a pair of separate endless flexible cables operatively coupled respectively to said clamps to position the latter individually, said cables extending transversely across the conveyor.

18. An apparatus according to claim 17, wherein said means for moving said clamps simultaneously from said loading station laterally in said one direction comprises separate drive means for separately driving said cables to move the respective clamps in said one direction to the middle of the apparatus.

19. An apparatus according to claim 18, wherein said means operable to spread the clamps apart includes means for reversing the drive to the cable for said one clamp while re-establishing the drive for moving said other clamp farther in said one direction.

20. An apparatus according to claim 16, wherein:

said means for actuating said clamps to release the laundry piece comprises a pair of stretch sensors positioned on opposite sides of the centerline of the conveyor for respectively sensing the movement past said stretch sensors of the top of the laundry piece hanging down from the clamps; and further comprising:

a time delay circuit operatively coupled to said stretch sensors to disable said stretch sensors from being actuated by the clamps as they move laterally outward past the stretch sensors.

21. An apparatus according to claim 16, wherein:

said means for actuating said clamps to release the laundry piece comprises a pair of stretch sensors positioned on opposite sides of the centerline of the conveyor for respectively sensing the movements past said stretch sensors of the top edge of the laundry piece hanging down from the clamps; and further comprising:

time delay means for delaying the release of the laundry piece by the clamps until a predetermined time interval has elapsed after the passage of the trailing edge of a preceding laundry piece past said trailing edge sensor means.

22. An apparatus according to claim 16, wherein:

said means for actuating said clamps to release the laundry piece comprises a pair of stretch sensors positioned on opposite sides of the centerline of the conveyor for respectively sensing the movement past said stretch sensors of the top edge of the laundry piece hanging down from the clamps; and further comprising:

means for blowing the laundry piece onto the conveyor after its release by the clamps;

and time delay means acting between said stretch sensors and said means for blowing to prevent a repeat operation of the latter in the event of closely repeated operations of said stretch sensors.

* * * * *